US010092072B2

(12) United States Patent
Capps-Tate

(10) Patent No.: US 10,092,072 B2
(45) Date of Patent: Oct. 9, 2018

(54) HANDBAGS

(71) Applicant: Candice Capps-Tate, San Mateo, CA (US)

(72) Inventor: Candice Capps-Tate, San Mateo, CA (US)

(73) Assignee: Henry Charles LLC, San Mateo, CA (US)

( * ) Notice: Subject to any disclaimer, the term of this patent is extended or adjusted under 35 U.S.C. 154(b) by 0 days.

(21) Appl. No.: 15/899,642

(22) Filed: Feb. 20, 2018

(65) Prior Publication Data

US 2018/0235333 A1 Aug. 23, 2018

Related U.S. Application Data

(60) Provisional application No. 62/461,999, filed on Feb. 22, 2017.

(51) Int. Cl.

| | |
|---|---|
| ***A45C 11/00*** | (2006.01) |
| ***A45C 5/00*** | (2006.01) |
| ***A45C 7/00*** | (2006.01) |
| ***A45D 29/20*** | (2006.01) |
| ***A45C 13/10*** | (2006.01) |

(52) U.S. Cl.

CPC ..... *A45C 5/005* (2013.01); *A45C 7/0059* (2013.01); *A45C 13/103* (2013.01); *A45C 13/1069* (2013.01); *A45D 29/20* (2013.01)

(58) Field of Classification Search

USPC ..... 206/581, 823; 150/106, 112, 114, 116, 150/117, 120

See application file for complete search history.

(56) References Cited

U.S. PATENT DOCUMENTS

| | | | | |
|---|---|---|---|---|
| 7,721,778 | B2 * | 5/2010 | Hess | A45C 13/26 150/119 |
| 2004/0195135 | A1 * | 10/2004 | Seamon | A45C 11/008 206/459.1 |
| 2007/0044877 | A1 * | 3/2007 | Davidoff | A45C 1/024 150/113 |
| 2007/0089818 | A1 * | 4/2007 | Bigel | A45C 3/06 150/113 |
| 2008/0060972 | A1 * | 3/2008 | Rappaport | A45C 3/06 206/581 |

(Continued)

*Primary Examiner* — Jacob K Ackun

(74) *Attorney, Agent, or Firm* — Aurora Consulting LLC; Ashley Sloat

(57) ABSTRACT

Described herein are cosmetic bags of various size, shapes, and configurations. In one embodiment, a cosmetic bag includes a first sidewall including a first coupling surface; a second sidewall coupled to the first sidewall and including a second coupling surface, the second sidewall and the second coupling surface defining a groove configured as a handle; a reversibly sealable pouch coupled to and between the first and second sidewalls, the pouch being visible between the first and second sidewalls in a closed configuration; a first divider between the first sidewall and the pouch, the first divider and the first sidewall defining a first slot and the first divider and the pouch defining a second slot; and a second divider between the second sidewall and the pouch, the second divider and the second sidewall defining a third slot and the second divider and the pouch defining a fourth slot.

20 Claims, 35 Drawing Sheets

(56) References Cited

U.S. PATENT DOCUMENTS

| | | | | |
|---|---|---|---|---|
| 2008/0236611 | A1* | 10/2008 | Redzisz | A45C 5/005<br>132/315 |
| 2012/0024438 | A1* | 2/2012 | Platt | A45C 3/04<br>150/105 |
| 2016/0183649 | A1* | 6/2016 | Gamble | A45C 3/06<br>150/107 |
| 2016/0249717 | A1* | 9/2016 | Ocleppo | A45C 3/08<br>150/105 |

* cited by examiner

HANDBAGS

CROSS-REFERENCE TO RELATED APPLICATIONS

This application claims the benefit of U.S. Provisional Ser. No. 62/461,999, entitled "Cosmetic Bags," filed on Feb. 22, 2017, the disclosure of which is herein incorporated by references in its entirety.

TECHNICAL FIELD

This disclosure relates generally to the field of handbags, and more specifically to the field of cosmetic and toiletry bags.

BACKGROUND

Currently available handbags suffer from several deficiencies: a lack of high-quality and long-lasting items, a lack of frustration-free openings and closures, a lack of product visibility and/or availability when handbags are in use, a lack of spill-resistant designs, a lack of efficient design to protect brush heads (yet still have them accessible), a lack of ample pockets and compartments, and a lack of correctly designed bag sizing to fit pro-sized makeup brushes and various types of beauty formula packaging. Thus, there is a need for new and useful handbags.

SUMMARY

The present disclosure relates to handbags. Various, non-limiting, features of the handbags described herein are tabs for opening and closing the handbags described herein, a combination of hard/structural and soft/bendable fabrics that form the handbags, frame closures to provide stability and durability to the handbags, magnetic closures for easy opening and closing of the handbags, magnets covered by or enclosed by material (e.g., fabric), finger-grip handles, and functional elastic detailing including, but not limited to, loops and closures.

In general, the handbags described herein are durable, flexible, adjustable, magnetic, secure, visible, Fumble-Free™, convenient, spill-resistant, wipeable, packable, and travel friendly.

One aspect of the present disclosure relates to a cosmetic bag having an open configuration and a closed configuration. In some embodiments, the cosmetic bag includes: a first sidewall including a first coupling surface; a second sidewall coupled to the first sidewall and including a second coupling surface, the second sidewall and the second coupling surface defining a groove configured as a handle, such that, in the closed configuration, the first coupling surface is configured to couple to the second coupling surface, and such that the first and second sidewall each comprise one or more loops and one or more pockets coupled thereto; a reversibly sealable pouch coupled to and between the first and second sidewalls, the pouch being visible between the first and second sidewalls in the closed configuration; a first divider between the first sidewall and the pouch, the first divider and the first sidewall defining a first slot and the first divider and the pouch defining a second slot; and a second divider between the second sidewall and the pouch, the second divider and the second sidewall defining a third slot and the second divider and the pouch defining a fourth slot.

In some embodiments, the one or more loops, the one or more pockets, an interior of the pouch, the first slot, the second slot, the third slot, and the fourth slot are all visible simultaneously when the cosmetic bag is in the open configuration.

In some embodiments, the first and second sidewalls are formed of a flexible material.

In some embodiments, the pouch includes a first side and a second side reversibly joined by a zipper.

In some embodiments, the cosmetic bag further includes a base. In some embodiments, the first and second sidewalls are coupled to the base, the first sidewall being coupled to the base along a half perimeter and the second sidewall being coupled to the base along an opposite half perimeter. In some embodiments, the base further includes one or more feet configured to maintain the base apart from a surface on which the cosmetic bag rests.

In some embodiments, the pouch houses two or more compartments therein.

In some embodiments, the first coupling surface includes a protruding permanent magnet and the second coupling surface includes a recessed ferromagnet.

In some embodiments, a material forming the first and second sidewalls covers the permanent magnet and the ferromagnet.

In some embodiments, one or more of the first divider, the second divider, and the one or more pockets are formed of mesh.

In some embodiments, a size of the one or more loops are adjustable.

In some embodiments, the cosmetic bag further includes a tab coupled to the first coupling surface, the tab being configured to be pulled to disengage the first coupling surface from the second coupling surface in the closed configuration.

Another aspect of the present disclosure relates to a cosmetic bag. In some embodiments, the cosmetic bag includes a base; a first sidewall extending from an edge of the base and coupled to a first coupling surface; a second sidewall extending from an opposite edge of the base and coupled to a second coupling surface, the second sidewall and the second coupling surface defining a groove configured as a handle, such that, in a closed configuration, the first coupling surface bends over the second coupling surface and is configured to couple to the second coupling surface, and such that the first and second sidewalls each includes one or more loops and one or more pockets coupled thereto; a reversibly sealable pouch between the first and second sidewalls, the pouch being visible between the first and second sidewalls in the closed configuration; a first divider between the first sidewall and the pouch, the first divider and the first sidewall defining a first pocket and the first divider and the pouch defining a second pocket; and a second divider between the second sidewall and the pouch, the second divider and the second sidewall defining a third pocket and the second divider and the pouch defining a fourth pocket. In some embodiments, the one or more loops, the one or more pockets, an interior of the pouch, the first pocket, the second pocket, the third pocket, and the fourth pocket are all visible simultaneously when the cosmetic bag is in an open configuration.

In some embodiments, the pouch houses two or more compartments therein.

In some embodiments, the first coupling surface includes a protruding permanent magnet and the second coupling surface includes a recessed ferromagnet.

In some embodiments, one or more of the first divider, the second divider, and the one or more pockets are formed of mesh.

In some embodiments, a size of the one or more loops are adjustable.

In some embodiments, the base further includes one or more feet configured to maintain the base apart from a surface on which the cosmetic bag rests.

In some embodiments, the pouch includes a zipper for sealing and unsealing the pouch.

In some embodiments, a width of the first sidewall tapers from a first end coupled to the base to a second end coupled to the first coupling surface.

BRIEF DESCRIPTION OF THE DRAWINGS

The foregoing is a summary, and thus, necessarily limited in detail. The above-mentioned aspects, as well as other aspects, features, and advantages of the present technology are described below in connection with various embodiments, with reference made to the accompanying photos and drawings.

The illustrated embodiments are merely examples and are not intended to limit the disclosure. The schematics are drawn to illustrate features and concepts and are not necessarily drawn to scale.

DETAILED DESCRIPTION

The foregoing is a summary, and thus, necessarily limited in detail. The above-mentioned aspects, as well as other aspects, features, and advantages of the present technology will now be described in connection with various embodiments. The inclusion of the following embodiments is not intended to limit the disclosure to these embodiments, but rather to enable any person skilled in the art to make and use the contemplated invention(s). Other embodiments may be utilized, and modifications may be made without departing from the spirit or scope of the subject matter presented herein. Aspects of the disclosure, as described and illustrated herein, can be arranged, combined, modified, and designed in a variety of different formulations, all of which are explicitly contemplated and form part of this disclosure.

Described herein are handbags configured for carrying one or more items therein. Such handbags may carry cosmetics, personal items, toiletry items, work-related items (e.g., pens, rulers, highlighters, scissors, etc.), toys, tools, surgical instruments, or any items that require transporting. In one such non-limiting embodiment, the handbags described herein are configured to carry cosmetics and/or toiletry items.

The handbags described herein are designed and configured to be used by a person, female, male, child, adolescent, adult, make-up artist, wedding or event planner, office manager, professional, architect, hobbyist, handyman, healthcare provider, or any other person that needs to transport items.

The handbags described herein are designed and configured to have an open configuration in which all items are accessible and a closed configuration in which one or more items are secured within the bag and the bag is ready for transport. In the open configuration, one or more handbags described herein are configured so that all pockets, pouches, loops, grooves, slots, compartments, bags, sacks, receptacles, channels, depressions, or an area otherwise suited to hold or carry one or more items are all simultaneously visible and accessible.

In general, the handbags described herein may be formed of or comprise mesh, nylon, leather, cotton, rayon, linen, wool, acetate, chiffon, acrylic, organza, lastex, velvet, polyesters, taffeta, denim, spandex, polypropylene, satin, fiberglass, vinyl, polyester, cotton canvas, polyester mesh, tricot jacquard, polyurethane, or a combination thereof. In some embodiments, handbags described herein are formed of or comprise one structural fabric, for example polyurethane, and one malleable, foldable, or bendable fabric, for example cotton canvas, polyester mesh, or tricot jacquard.

Figure 1:
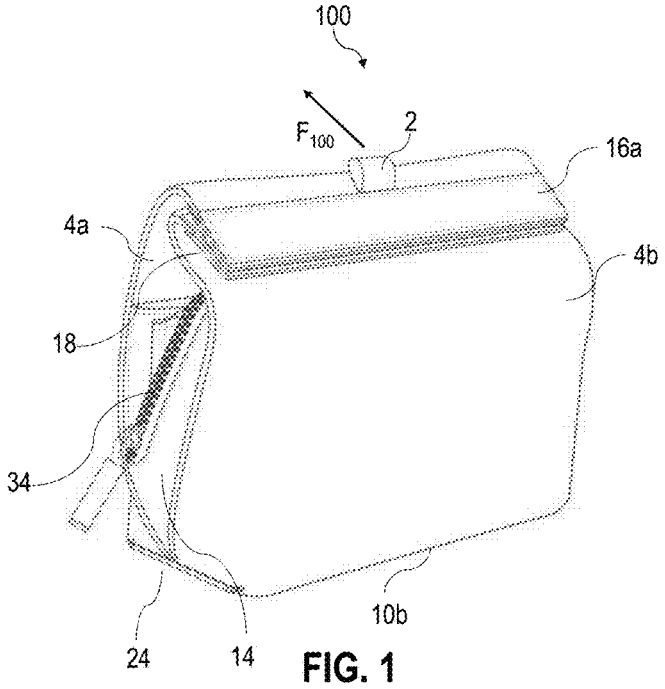
FIG. 1 illustrates a perspective view of one embodiment of a handbag.
Figure 2:
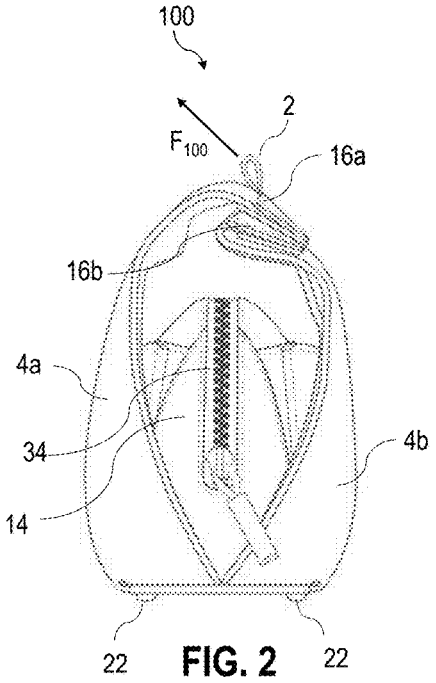
FIG. 2 illustrates a side view of one embodiment of the handbag of FIG. 1.
Figure 3:
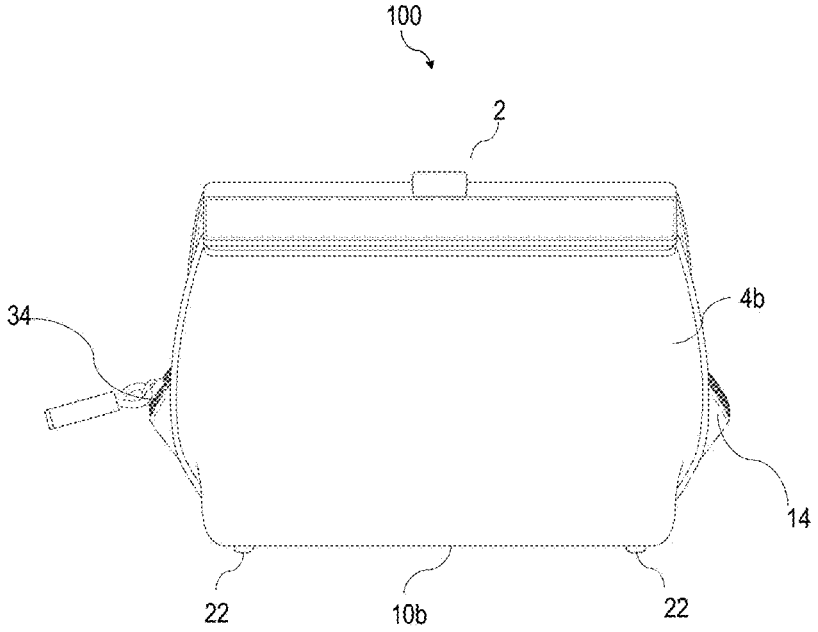
FIG. 3 illustrates a front view of one embodiment of the handbag of FIG. 1.
Figure 5:
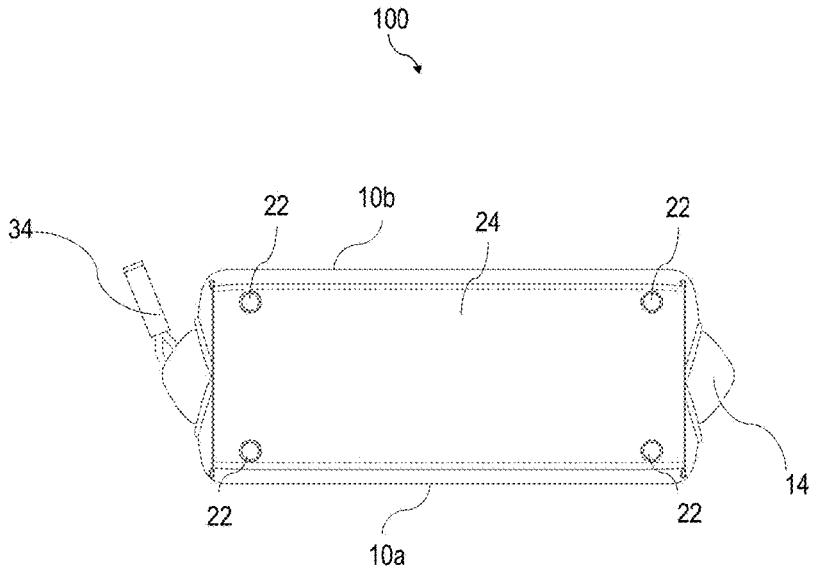
FIG. 5 illustrates a bottom view of one embodiment of the handbag of FIG. 1.
Figure 6:
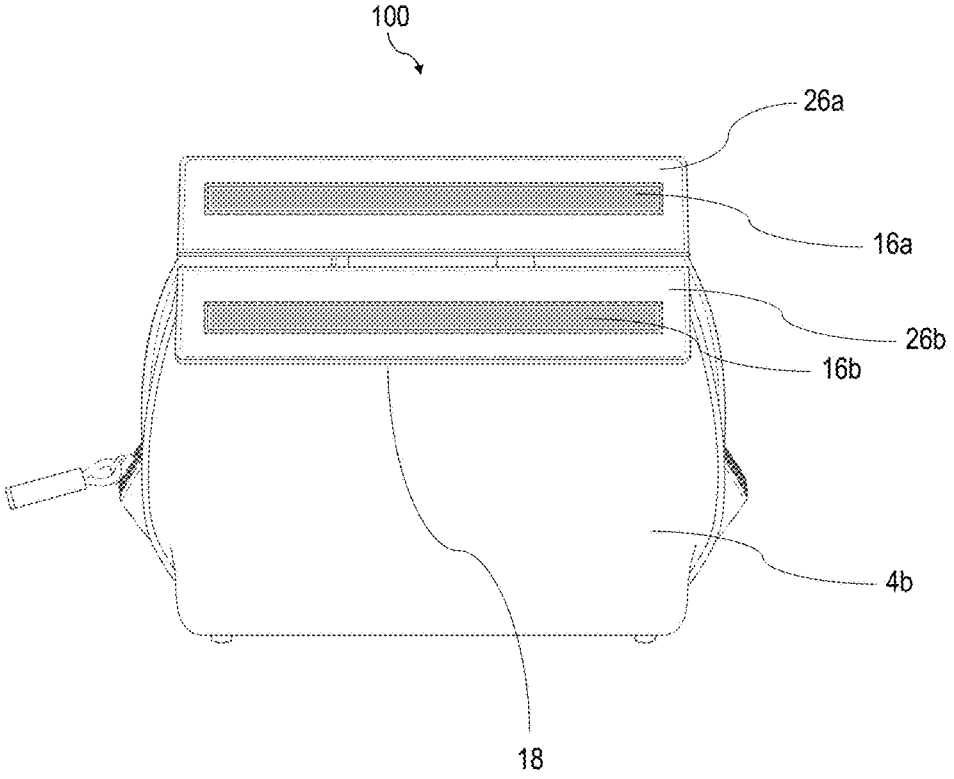
FIG. 6 illustrates a front view of one embodiment of the handbag of FIG. 3, showing first and second coupling surfaces.
Figure 7:
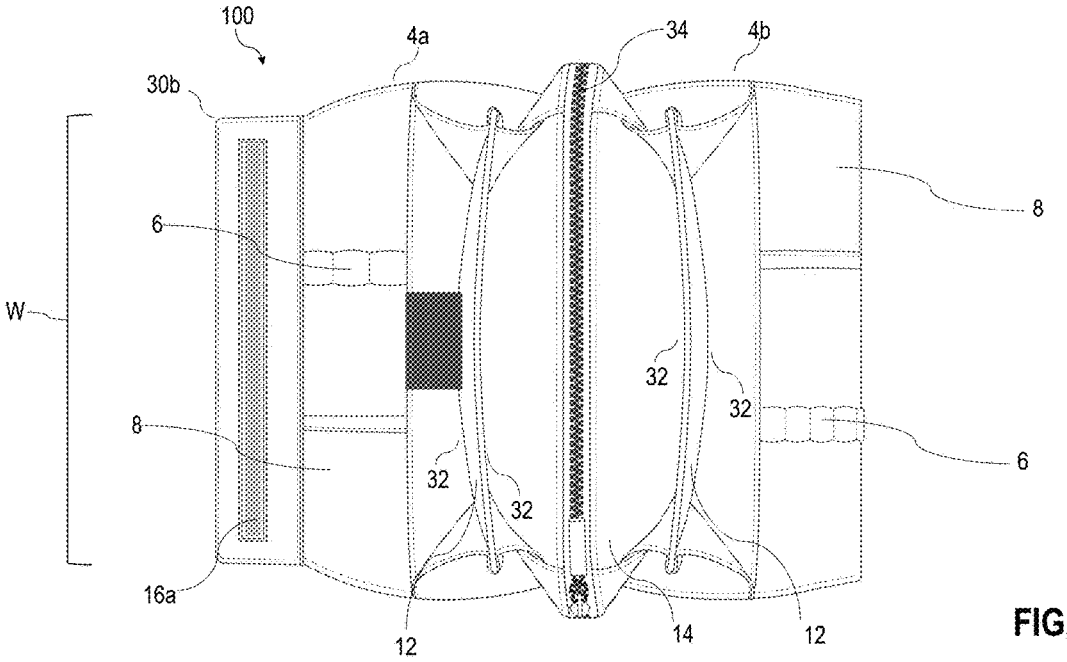
FIG. 7 illustrates a top view of one embodiment of an open configuration of the handbag of FIG. 1.

One embodiment of a handbag 100 is shown and described in FIGS. 1-8. The handbag 100 as shown in FIGS. 1-8 functions to provide enhanced organization for a wide variety of beauty items from beauty essentials to everyday routine beauty products and tools. In general, pulling on the tab 2 with force $F_{100}$, as shown in FIGS. 1-2, causes the handbag 100 to move from a closed configuration (FIGS. 1-5) to an open configuration (FIG. 7). In the open configuration, various compartments are revealed, for example, sidewalls 4*a*, 4*b* with loops 6 (e.g., elastic or other stretchable material), pockets 8, and parallel dividers 12. These compartments can easily be accessed with one hand, while the main reversibly sealable compartment or pouch 14 remains closed. In such embodiments, the pouch 14 prevents liquids that may have spilled in this compartment from reaching the other compartments, e.g., loops 6, pockets 8, dividers 12, on the exterior of the pouch 14. Loops 6 on an inner surface of sidewalls 4*a*, 4*b* are configured to store elongate items. Non-limiting examples of elongate items include: mascara, large and small brushes, and eyeliner, but may also include non-beauty or makeup related items (e.g., surgical instruments, tools, pens, pencils, etc.). Loops 6 are configured with larger or small diameters to support larger and smaller elongate items, respectively. For example, an eyeliner has a smaller diameter than a diameter of a blush or foundation brush. Further, in some embodiments, loops 6 are adjustable such that applying tension to one loop results in a shrinking diameter in one or more adjacent loops while the loop to which tension is applied increases in diameter; in other embodiments, loops 6 have a fixed diameter and/or position.

In some embodiments, the handbag 100 includes 4, 5, 6, 7, 8, 9, 10, 11, or 12 compartments therein. In some embodiments, the handbag 100 includes 4-6, 6-8, 8-10, 10-12, and 12-14 compartments therein or any range or subrange therebetween. Various embodiments of handbag 100 include an accordion design to maximize space in handbag 100.

Further, in general, handbag 100 is configured such that bottles comprising liquid can stand upright within handbag 100 to avoid spilling during transport and/or use.

In some embodiments, as shown at least in FIG. 6, handbag 100 is secured in a closed configuration using complementary coupling surfaces 16*a*, 16*b* (e.g., magnetic surfaces). In some embodiments, as shown in FIG. 6, coupling surface 16*a* bends or folds over coupling surface 16*b* and couples to coupling surface 16*b* to form the closed configuration shown, for example, in FIG. 3. Coupling surface 16*b* and sidewall 4*b* together define groove 18, which functions as a handle for handbag 100. A user's fingers slip into the groove 18 for conveniently carrying handbag 100 while traveling or transporting handbag 100.

In some embodiments, the top and/or bottom coupling surfaces 16*a*, 16*b* each comprise or are formed of a magnetic surface, for example one magnet or 2, 3, 4, or 5 adjacent magnets forming one surface. In some embodiments, the top coupling surface 16*a* is a protruding permanent magnet and the bottom coupling surface 16*b* is a recessed ferromagnet. In other embodiments, the top coupling surface 16*a* is a protruding ferromagnet, a recessed permanent magnet, or a recessed ferromagnet and the bottom coupling surface 16*b* is a recessed permanent magnet, a protruding permanent magnet, or a protruding ferromagnet. The protruding permanent magnet has a complementary size and shape to the recessed ferromagnet so as to create a tight or snug seal between the two surfaces 16*a*, 16*b*. In some embodiments, one or more materials that form the first and/or second sidewalls 4*a*, 4*b* may cover the top and bottom coupling surfaces 16*a*, 16*b*. Additionally or alternatively, the top and/or bottom coupling surfaces 16*a*, 16*b* may be further defined by a perimeter 26*a*, 26*b* to, for example, demarcate one or more boundaries of the top and/or bottom coupling surfaces 16*a*, 16*b*, as shown in FIG. 6.

Turning to FIGS. 1-5, in some embodiments, handbag 100 includes base 24; a first sidewall 4*a* extending from edge 10*a* of base 24 and coupled to a first or top coupling surface 16*a*; and a second sidewall 4*b* extending from an opposite edge 10*b* of the base 24. The second sidewall 4*b* is coupled to a second or bottom coupling surface 16*b*. In a closed configuration, the top coupling surface 16*a* bends over the bottom coupling surface 16*b* and couples to the bottom coupling surface 16*b*.

In some embodiments, coupling surfaces 16*a*, 16*b* and base 24 are formed of or comprise a hard or structural material (e.g., leather) and sidewalls 14*a*, 14*b* are formed of or comprise a soft, bendable, or compliant material. Such use of hard materials provides structure and support in handbag 100.

In some embodiments, as shown at least in FIG. 5, handbag 100 includes one or more feet 22 on base 24 of handbag 100 to maintain handbag 100 above a surface on which it rests and/or to avoid water submersion of handbag 100 during use in wet environments. In alternative embodiments, handbag 100 does not include feet 22. In other embodiments, handbag 100 does not include a base 24; in such embodiments, sidewalls 14*a* and 14*b* are joined together to form a bottom surface of the handbag 100.

Figure 4:
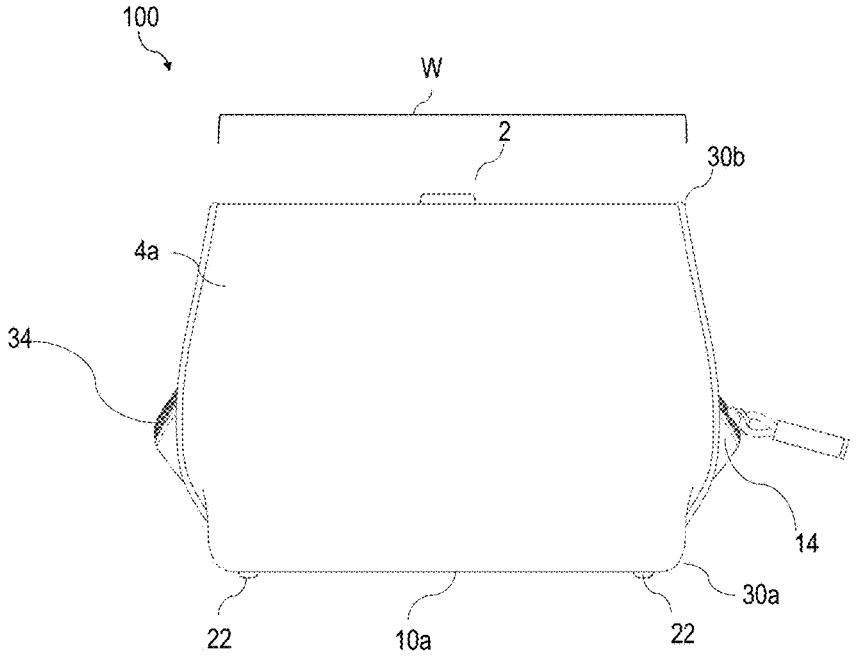
FIG. 4 illustrates a rear view of one embodiment of the handbag of FIG. 1.

In some embodiments, as shown in FIG. 4 and FIG. 7, a width W of the first sidewall 4*a* tapers from a first end 30*a* coupled to the base 24 to a second end 30*b* coupled to the top coupling surface 26*a*. A similar tapering effect is also seen in the second sidewall 4*b*.

Figure 8:
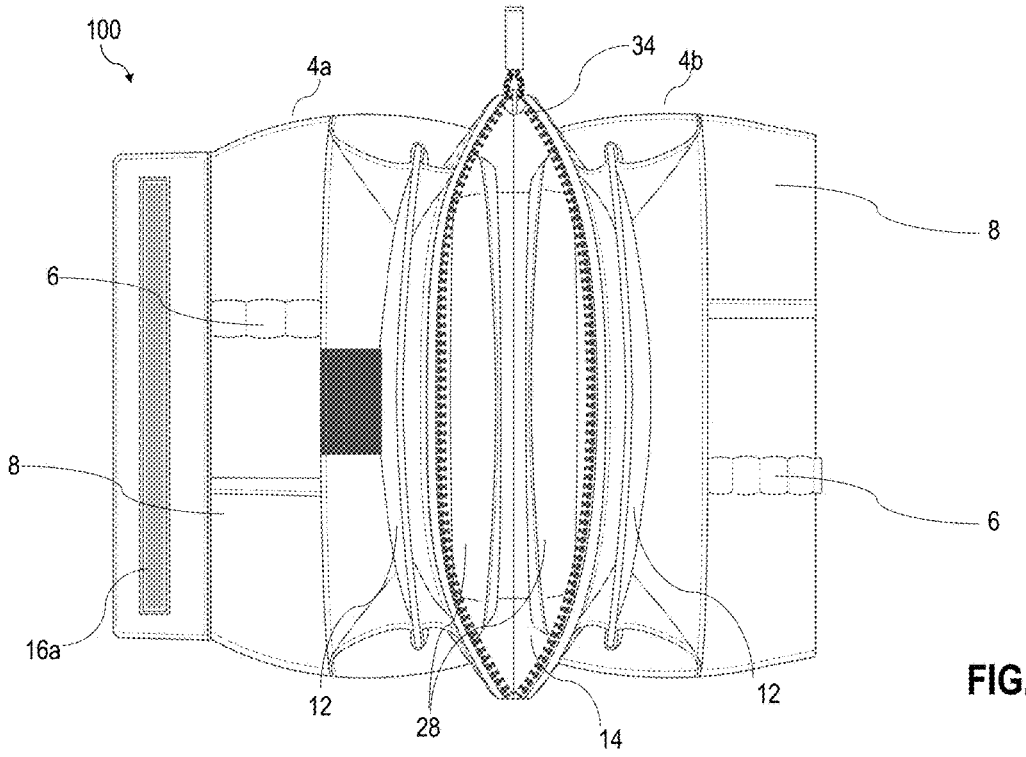
FIG. 8 illustrates another top view of one embodiment of an open configuration of the handbag of FIG. 1.
Figure 9:
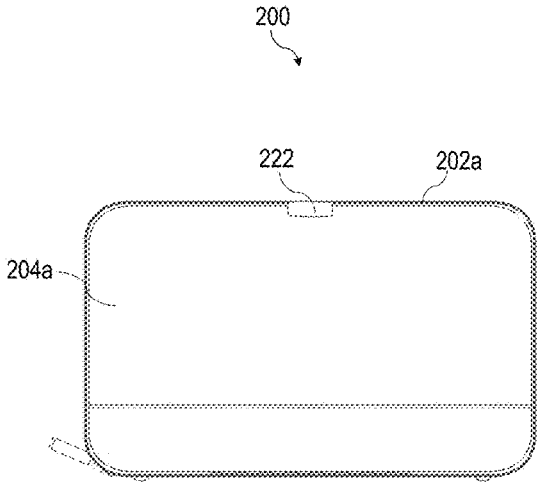
FIG. 9 illustrates a front view of another embodiment of a handbag.
Figure 10:
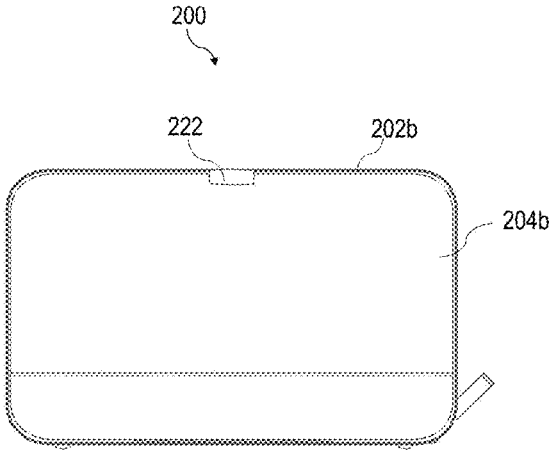
FIG. 10 illustrates a rear view of one embodiment of the handbag of FIG. 9.

In some embodiments, as shown in FIGS. 1-5 and 7-8, handbag 100 includes a reversibly sealable pouch 14 between the first and second sidewalls 4*a*, 4*b*, the pouch 14 being visible between the first and second sidewalls 4*a*, 4*b* when handbag 100 is in the closed configuration, as shown in FIGS. 1-5. Turning to FIG. 8, the pouch 14 is a compartment in and of itself but may also include, in some embodiments, one or more additional dividers, compartments, or pockets therein. As shown in FIG. 8, in some embodiments, pouch 14 includes one or more pockets 28. The pouch 14 is configured to receive or house one or more receptacles or bottles in an upright or standing orientation to prevent spilling of the contents of the receptacles or bottles. In some embodiments, pouch 14 is not sealable or cannot be closed; in other embodiments, pouch 14 is reversibly sealable via coupling element 34, for example via a zipper, one or more buttons or hooks and eyelets, one or more fasteners, Velcro®, one or more magnets, one or more sutures or ties, or any other suitable material or structure.

In some embodiments, as shown in FIGS. 7-8, handbag 100 includes one or more dividers 12 between the first sidewall 4*a* and the pouch 14 and/or the second sidewall 4*b* and the pouch 14. The sidewall 4*a*, 4*b* and the divider 12 together define a slot 32 and the divider 12 and the pouch 14 together define another slot 32. In some embodiments, there are two dividers 12, one between each sidewall and the pouch 14, defining four slots 32. In other embodiments, there is one divider, defining two slots 32, or a plurality of dividers.

In some embodiments, one or more of sidewalls, dividers, pockets, pouches, compartments, surfaces, or loops may be formed of or comprise mesh, nylon, leather, cotton, rayon, linen, wool, acetate, chiffon, acrylic, organza, lastex, velvet, polyesters, taffeta, denim, spandex, polypropylene, satin, fiberglass, vinyl, polyurethane, or a combination thereof; in one embodiment, the one or more pockets 8 and one or more dividers 12 comprise or are formed of mesh.

In some embodiments of handbag 100, one or more loops 6, the one or more pockets 8, an interior of the pouch 14, the first slot, the second slot, the third slot, and the fourth slot are all visible simultaneously when handbag 100 is in an open configuration, as shown in FIG. 8.

Figure 11:
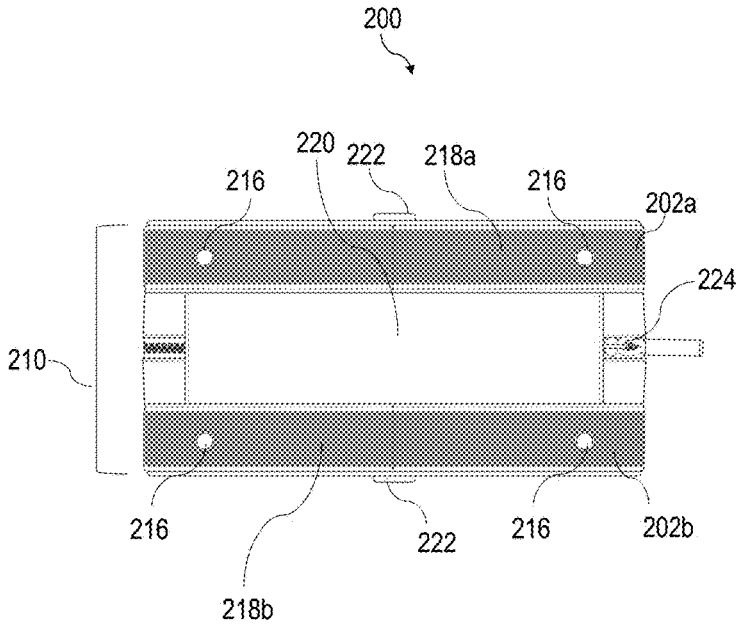
FIG. 11 illustrates a bottom view of one embodiment of the handbag of FIG. 9.
Figure 12:
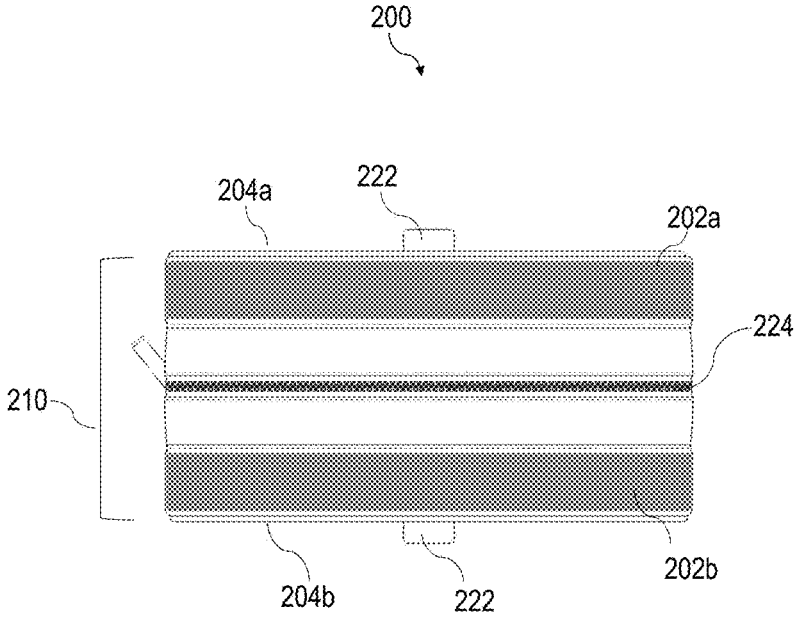
FIG. 12 illustrates a top view of one embodiment of the handbag of FIG. 9.
Figure 13:
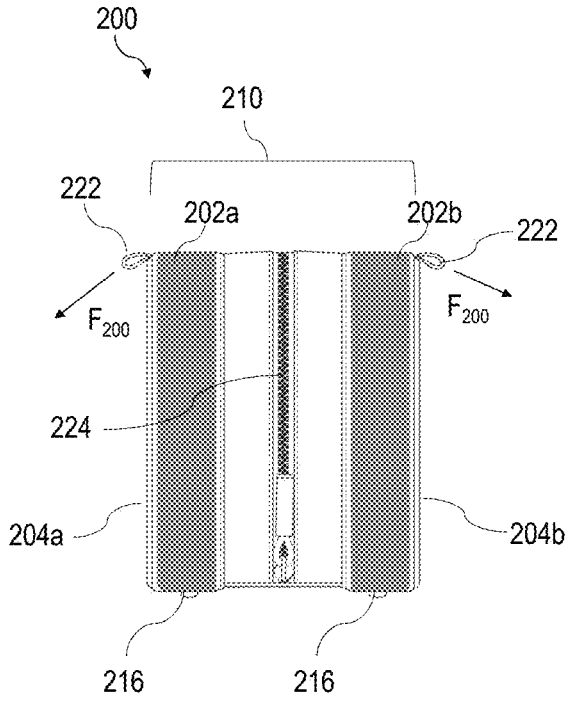
FIG. 13 illustrates a side view of one embodiment of the handbag of FIG. 9.
Figure 14:
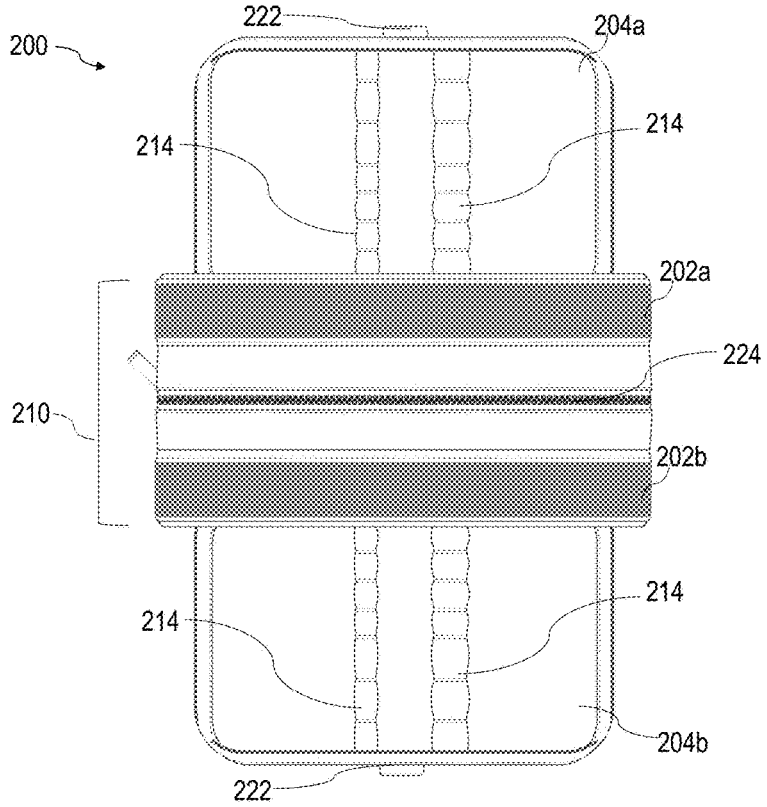
FIG. 14 illustrates a top view of one embodiment of a partially open configuration of the handbag of FIG. 9.
Figure 15:
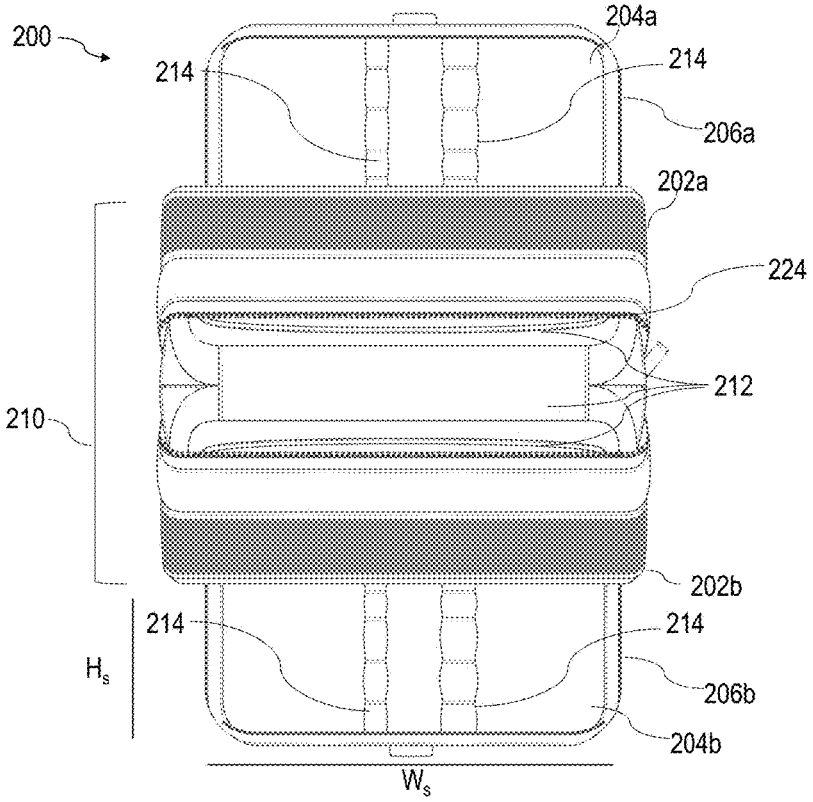
FIG. 15 illustrates a top view of one embodiment of a fully open configuration of the handbag of FIG. 9.
Figure 16:
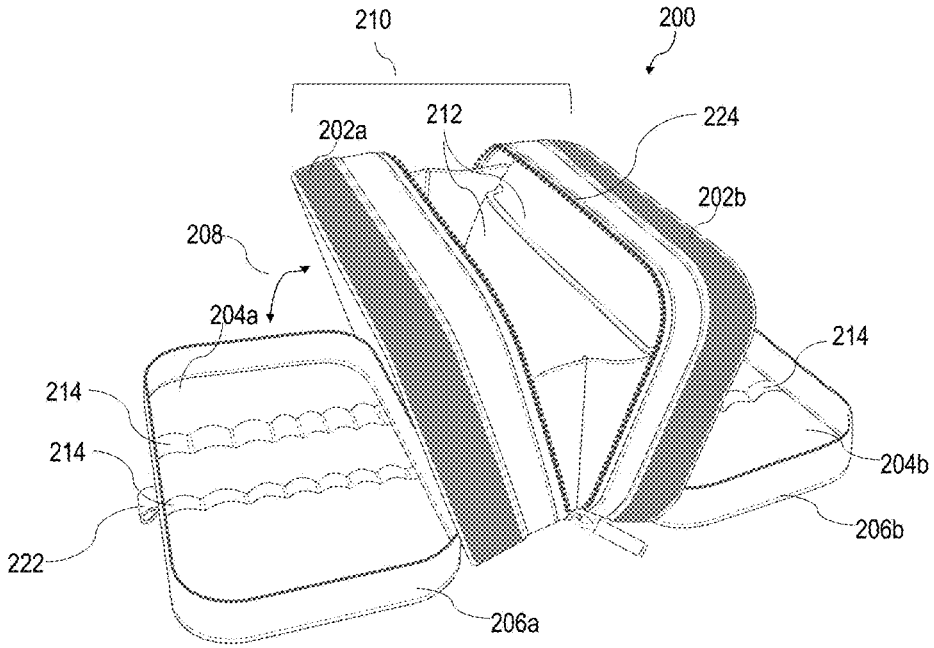
FIG. 16 illustrates a perspective view of one embodiment of a fully open configuration of the handbag of FIG. 9.
Figure 17:
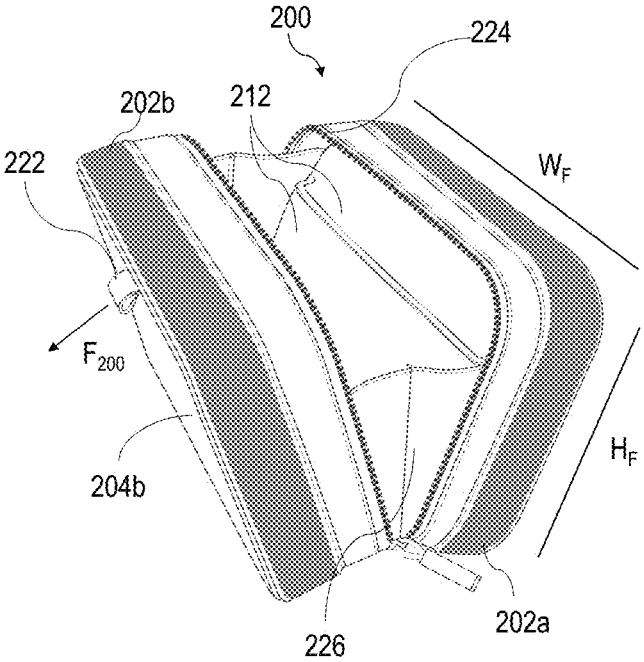
FIG. 17 illustrates a perspective view of one embodiment of a partially open configuration of the handbag of FIG. 9.

Another embodiment of a handbag is shown in FIGS. 9-17. Handbag 200 functions to store and organize products and tools. In general, handbag 200 includes housing 210, including frames 202*a*, 202*b*, configured to sit upright on a surface, as shown in FIGS. 9-13. Handbag 200 includes a first side compartment 204*a* and a second side compartment 204*b*, as shown in FIG. 12. In some embodiments, frames 202*a*, 202*b* and/or side compartments 204*a*, 204*b* have a rigid or substantially rigid structure or construction. The first and second side compartments 204*a*, 204*b* are each defined by a plurality of sidewalls 206*a*, 206*b*, respectively, as shown in FIG. 15. In the closed configuration of handbag 200, the plurality of sidewalls 206*a*, 206*b* are sized and configured to snugly be received or nestled within frames 202*a*, 202*b*, respectively, as shown in FIGS. 9-13 and by arrow 208 in FIG. 16. In some embodiments, side compartments 204*a*, 204*b* including sidewalls 206*a*, 206*b* are disengaged from frames 202*a*, 202*b* by an outward force $F_{200}$ being applied to tabs 222, as shown in FIGS. 13 and 17.

In some embodiments, a height $H_s$ and width $W_s$ of each side compartment 204*a*, 204*b* including the plurality of sidewalls 206*a*, 206*b*, as shown in FIG. 15, is less than a height $H_F$ and width $W_F$ of each frame 202*a*, 202*b*, as shown in FIG. 17, so that each side compartment 204*a*, 204*b* fits snugly into each respective frame 202*a*, 202*b*.

In some embodiments, frames 202*a*, 202*b* are at least partially joined together to form housing 210 via base 220, as shown in FIG. 11.

Turning to FIGS. 15-17, housing 210 is reversibly sealable via coupling element 224, for example a zipper, one or more buttons or hooks and eyelets, one or more fasteners, Velcro®, one or more magnets, one or more sutures or ties, or any other suitable material or structure. In an open configuration, as shown in FIGS. 15-17, housing 210 opens to reveal one or more compartments 212 therein. Compartments 212 are sized and configured to store, house, carry, or otherwise hold one or more tools, cosmetics, or receptacles. In some embodiments, one or more receptacles or bottles are maintained in an upright position in housing 210. In some embodiments, compartments 212 are transparent; in other embodiments, compartments 212 are opaque. In some embodiments, transparency of compartments 212 is dependent on one or more side compartments 204*a*, 204*b* being in an open configuration (Force $F_{200}$ applied to tabs to open side compartments 204*a*, 204*b*) so as to let natural or artificial light in through sides of handbag 200. In some embodiments, compartments 212 comprise one large compartment and two smaller pockets or slip pockets. As shown in contrasting FIGS. 14-15 and FIG. 17, the side compartments 204*a*, 204*b* may be opened and the housing 210 closed (FIG. 14), the side compartments 204*a*, 204*b* open and the housing 210 open (FIG. 15), or the side compartments 204*a*, 204*b* closed and the housing 210 open (FIG. 17) all while the handbag 200 rests comfortably and stably on a surface. Further, as shown in FIG. 17, handbag 200 includes barrier 226 that functions to prevent items from falling out of compartment 212 and maintain frames 202*a*, 202*b* within proximity to one another and/or less than 90° with respect to each other.

As shown in FIGS. 14-16, side compartments 204*a*, 204*b* include a plurality of loops 214. In some embodiments, the plurality of loops 214 are adjustable such that applying tension to one loop results in a shrinking diameter in one or more adjacent loops while the loop to which tension is applied increases in diameter; in other embodiments, the plurality of loops 214 have a fixed diameter and/or position.

In some embodiments, as shown at least in FIG. 11, the handbag 200 includes one or more feet 216 on a bottom surface 218*a*, 218*b* of frames 202*a*, 202*b* of handbag 200 to maintain handbag 200 above a surface on which it rests and/or to avoid water submersion of handbag 200 during use in wet environments. In other embodiments, handbag 200 does not include feet 216.

Figure 18:
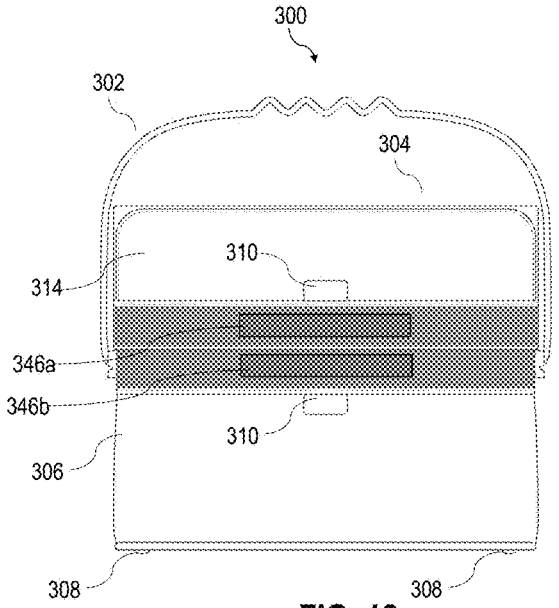
FIG. 18 illustrates a front view of another embodiment of a handbag.
Figure 19:
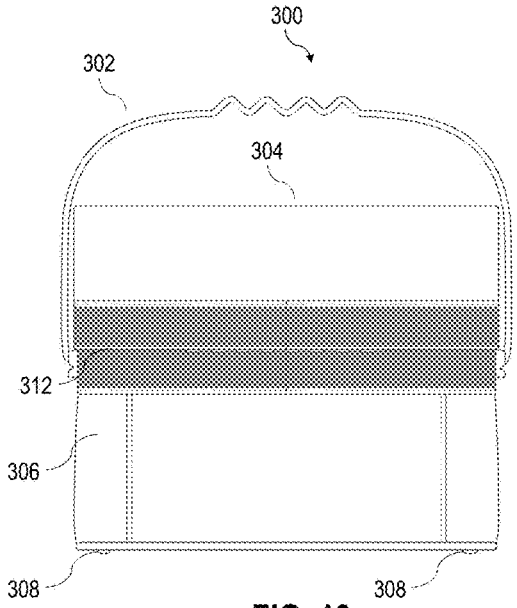
FIG. 19 illustrates a back view of one embodiment of the handbag of FIG. 18.
Figure 20A:
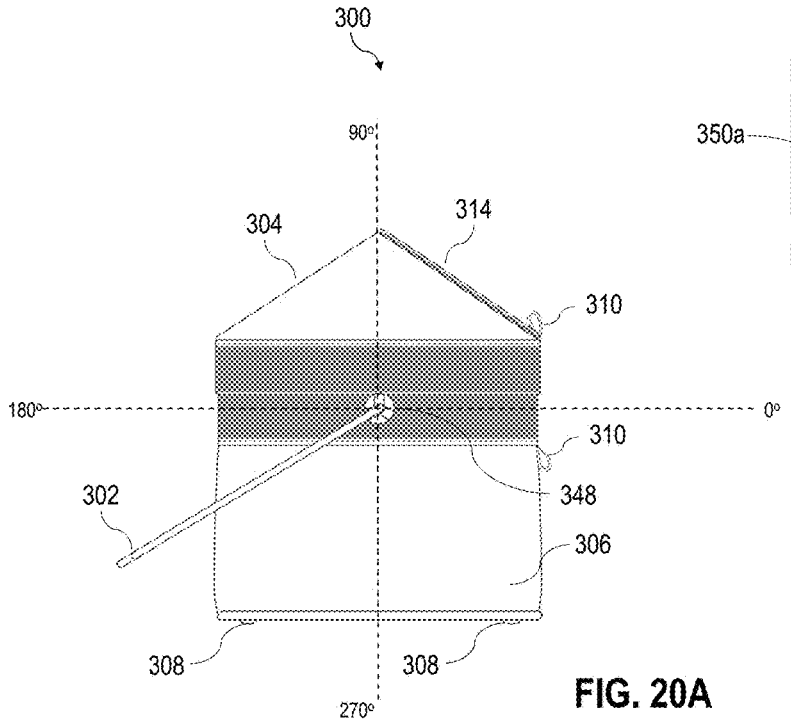
FIG. 20A illustrates a side view of one embodiment of the handbag of FIG. 18.
Figure 20B:
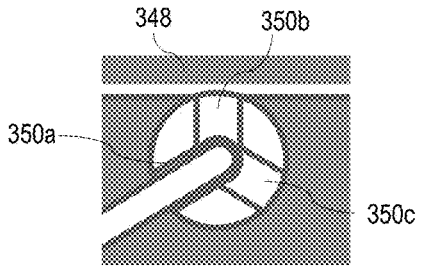
FIG. 20B illustrates a zoomed in view of one embodiment of a handle mechanism of the handbag of FIG. 20A.
Figure 21A:
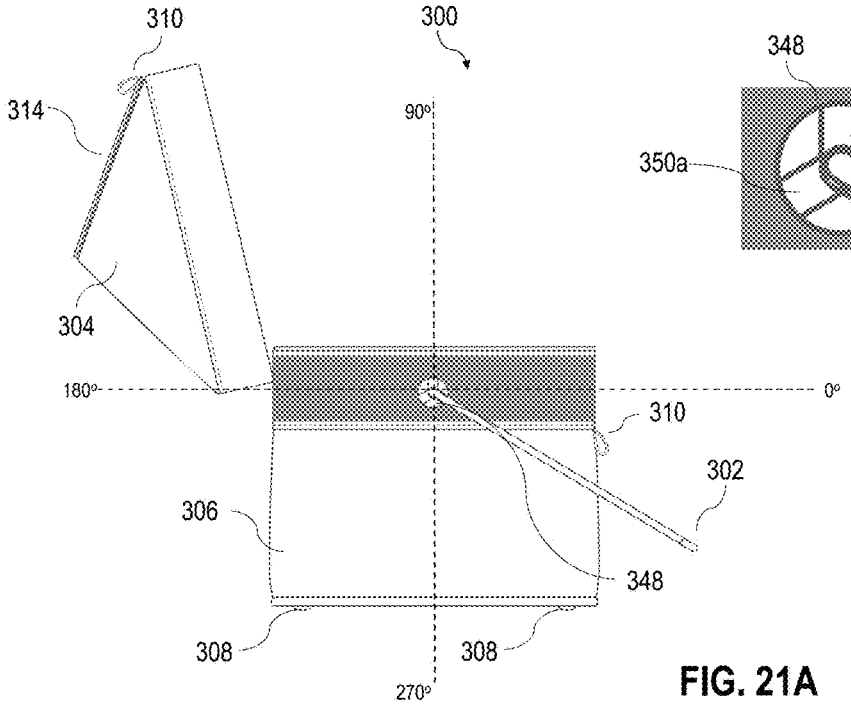
FIG. 21A illustrates a side view of one embodiment of the handbag of FIG. 18.
Figure 21B:
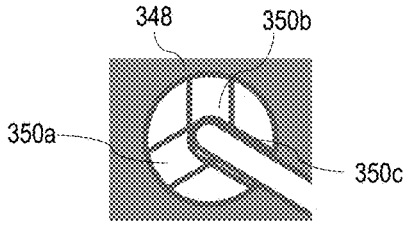
FIG. 21B illustrates a zoomed in view of one embodiment of a handle mechanism of the handbag of FIG. 21A.
Figure 22A:
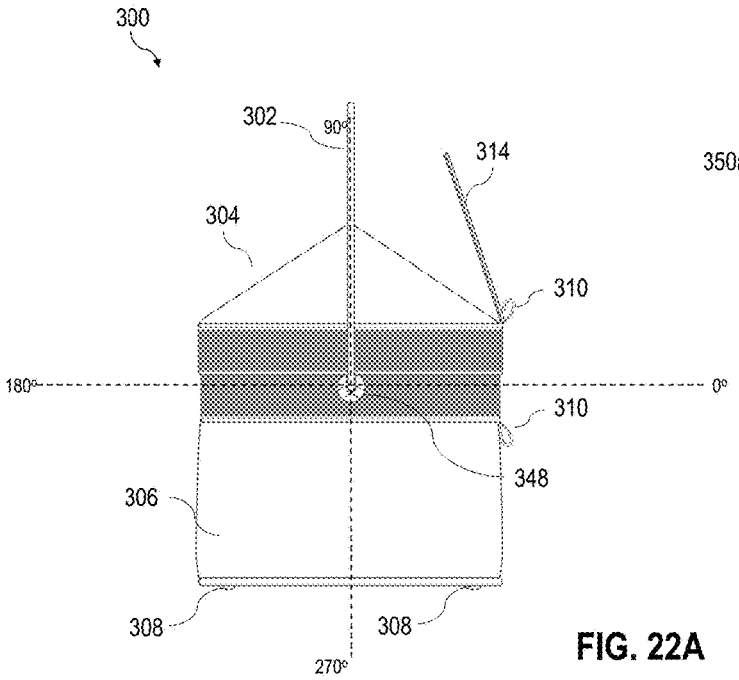
FIG. 22A illustrates a side view of one embodiment of a locked or carrying configuration of the handbag of FIG. 18.
Figure 22B:
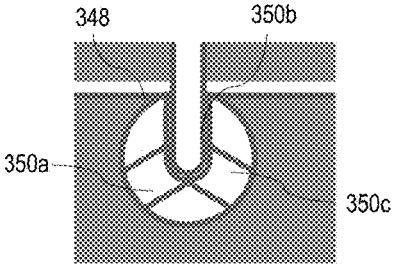
FIG. 22B illustrates a zoomed in view of one embodiment of a handle mechanism of the handbag of FIG. 22A.
Figure 23:
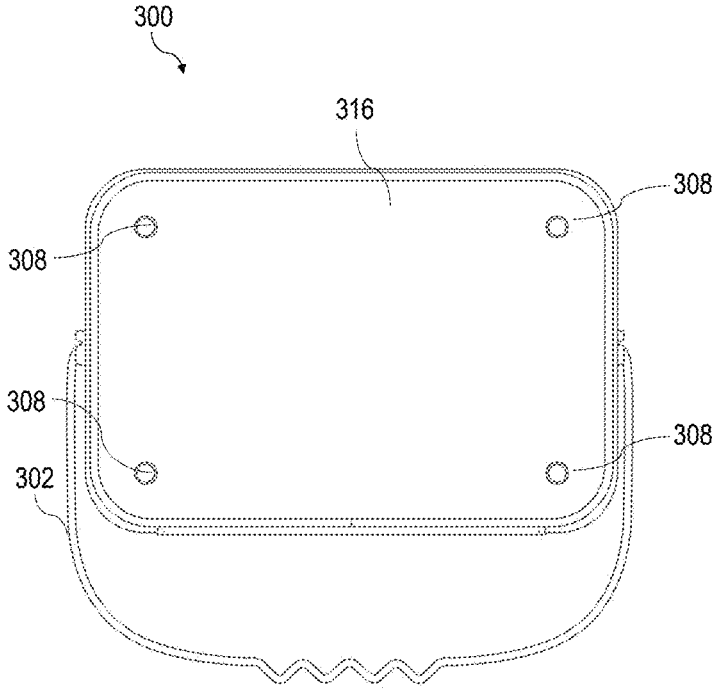
FIG. 23 illustrates a bottom view of one embodiment of the handbag of FIG. 18.
Figure 24:
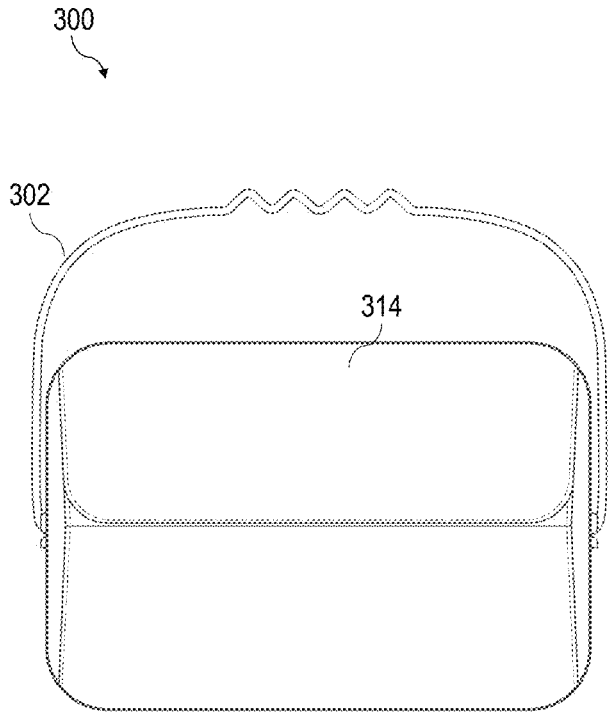
FIG. 24 illustrates a top view of one embodiment of the handbag of FIG. 18.
Figure 25:
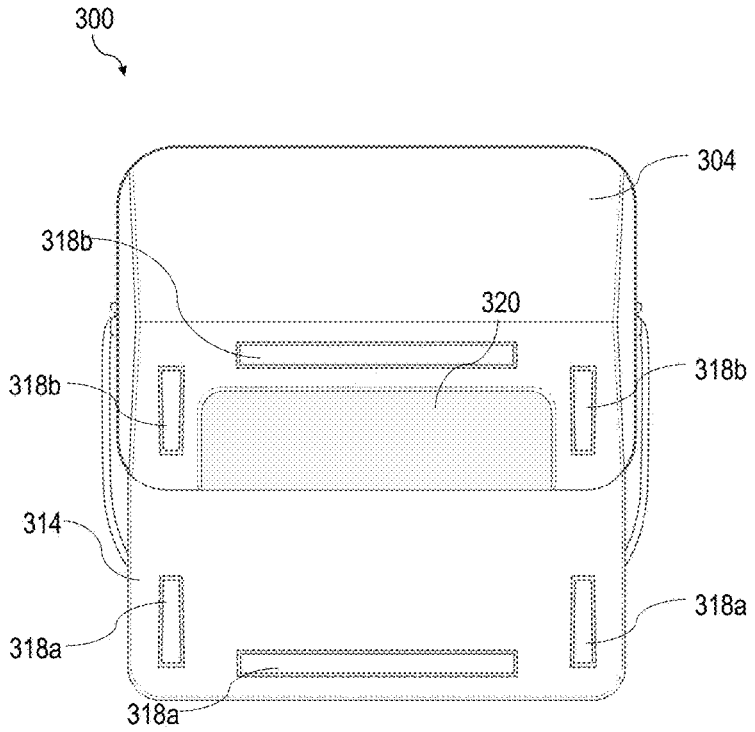
FIG. 25 illustrates a top view of one embodiment of the handbag of FIG. 18, showing an open configuration of a lid.
Figure 26:
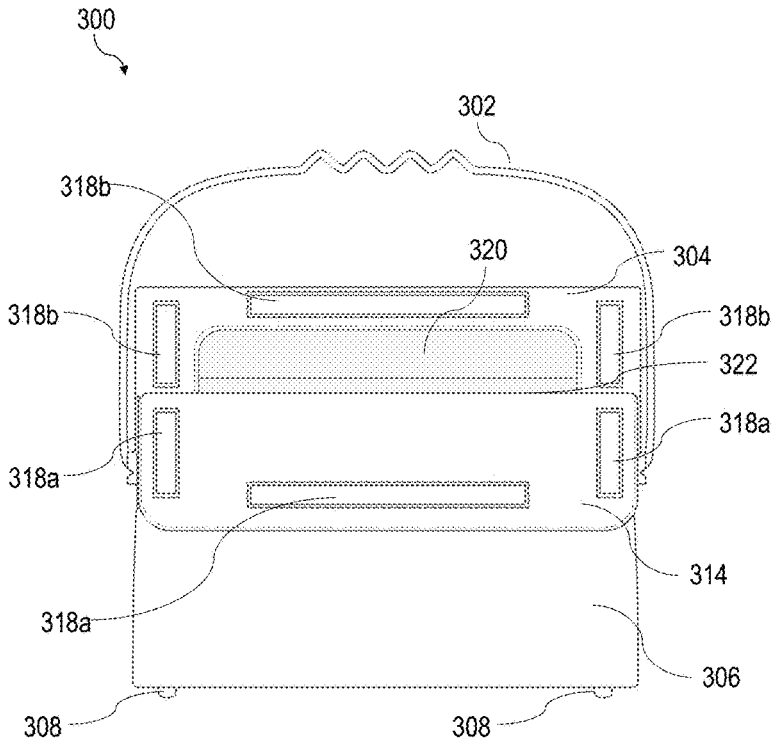
FIG. 26 illustrates a front view of the handbag of FIG. 25.

Turning now to FIGS. 18-30, another embodiment of a handbag is shown and described. Handbag 300 functions to store items and/or products in various compartments in handbag 300. For example, handbag 300 includes a compartment in lid 304 and various compartments in body 306. Lid 304 couples to body 306 via magnets 346*a*, 346*b*. In some embodiments, as shown in FIGS. 18-19, magnets 346*a*, 346*b* are centered on tabs 310 on a front of handbag 300. In other embodiments, magnets 346*a*, 346*b* are located on a side or back of handbag 30. In still other embodiments, magnets 346*a*, 346*b* each comprise two or more magnets on a front, side, or back surface of handbag 300. In still other embodiments, magnets 346*a*, 346*b* surround a perimeter of lid 304 and body 306 at the point of contact between lid 304 and body 306. As shown in FIGS. 18-23, handbag 300 includes a contoured handle 302 that is coupled to body 306 via mechanism 348. As shown in FIGS. 20B, 21B, and 22B, mechanism 348 includes n number of grooves 350 equal to the number of desired handle 302 lock positions. Handle 302 pops in and out of grooves 350 using an inner spring. For example, as shown in FIGS. 20A-21B, handle 302 is configured to lock in a first groove 350*a* behind the handbag 300 at substantially 225° (FIGS. 20A-20B) or in a third groove 350*c* in front of the handbag 300 at substantially 315° (FIGS. 21A-21B), to allow the user to access the contents in the lid 304 or in the body 306. One of skill in the art will recognize that any angle greater than 180° can be used to lock the handle 302 to allow access to the contents in lid 304 or in body 306. In some embodiments, as shown in FIGS. 22A-22B, handle 302 locks in a second groove 350*b* at substantially 90° to enable transport and/or carrying of handbag 300. As shown in FIGS. 22A-22B, locking handle 302 at substantially 90° ensures that the contents of handbag 300 will be securely held therein during transport and/or carrying. Handle 302 is moved over lid 304 of handbag 300 between the 315° position, 90° position, and 180° position to access contents in handbag 300 or to transport handbag 300. In other embodiments, handle 302 may be moved between the various positions by passing handle 302 under body 306.

Handle 302 is contoured to have a complementary surface to one or more fingers of a user of handbag 300. For example, handle 302 may include one or more bevels or concave grooves configured to rest on one or more fingers of a user while the user is carrying or transporting handbag 300.

Returning to FIG. 19, lid 304 is coupled to body 306 via hinge 312. Hinge 312 may be a butt hinge, barrel hinge, piano hinge, butterfly hinge, flush hinge, pivot hinge, spring hinge, gate hinge, or any other type of hinge that allows lid 304 to be partially decoupled (i.e., opened) from body 306. Further, as shown in FIGS. 18, 20-22, 24-26, lid 304 includes compartment 320 that is reversibly sealed by flap 314. In some embodiments, compartment 320 is shaped as a tetrahedron (three-dimensional triangle); in other embodiments, compartment 320 is shaped as a cube, cylinder, sphere, or any other three-dimensional polygon. Flap 314 is hingedly coupled to lid 304 via hinge 322 and folds over and couples to lid 304 via coupling elements 318*a*, 318*b*. In some embodiments, hinge 322 is a bend in the fabric or material that forms lid 304 and flap 314; in other embodiments, hinge 322 is a separate element, for example a butt hinge or piano hinge as described elsewhere herein. Coupling elements 318*a*, 318*b* may include or be formed of a zipper, one or more buttons or hooks and eyelets, one or more fasteners, Velcro®, one or more magnets, one or more sutures or ties, or any other suitable material or structure. In one embodiment, coupling elements 318*a* comprise permanent magnets and coupling elements 318*b* comprise ferromagnets, but the reverse may also be true. Further, as described elsewhere herein in connection with FIGS. 6-8, coupling elements 318*a*, 318*b* may be recessed or protruding.

In some embodiments, as described elsewhere herein, handbag 300 includes one or more feet 308 for maintaining handbag 300 above a surface on which is rests, as shown at least in FIGS. 18-23.

Figure 27:
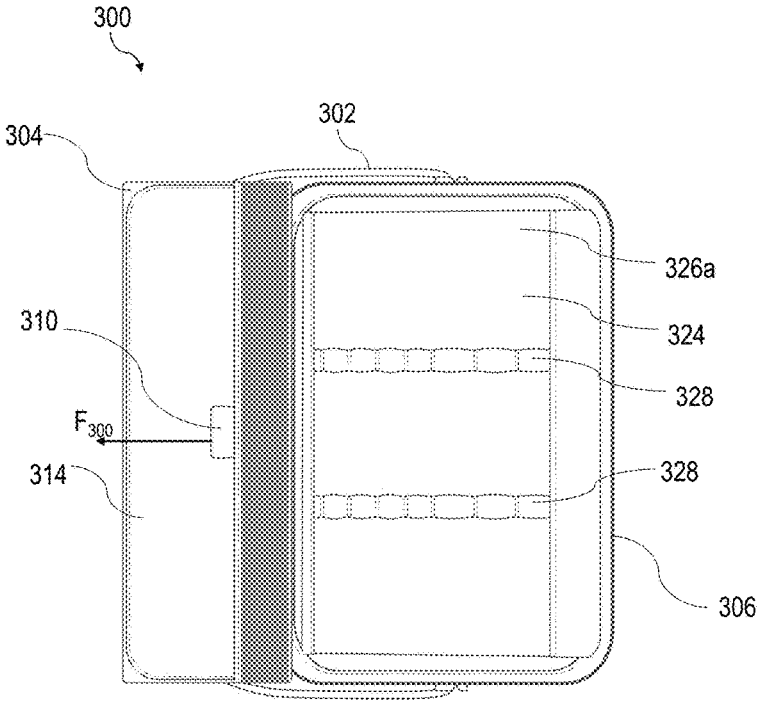
FIG. 27 illustrates a top view of one embodiment of a partially open configuration of the handbag in FIG. 18.
Figure 28:
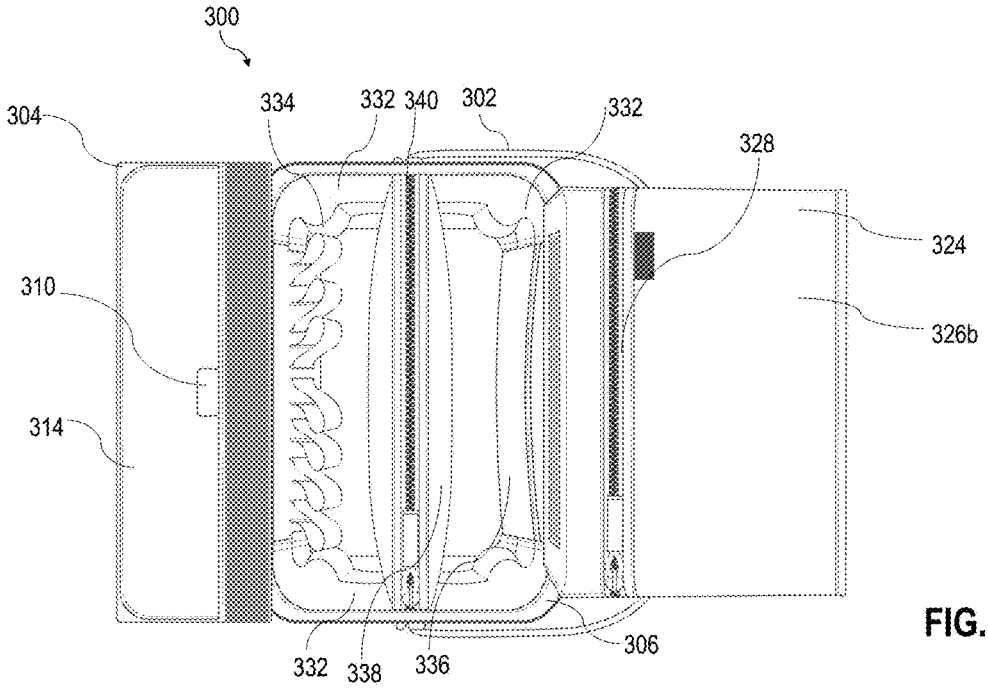
FIG. 28 illustrates a top view of one embodiment of a fully open configuration of the handbag in FIG. 18.
Figure 29:
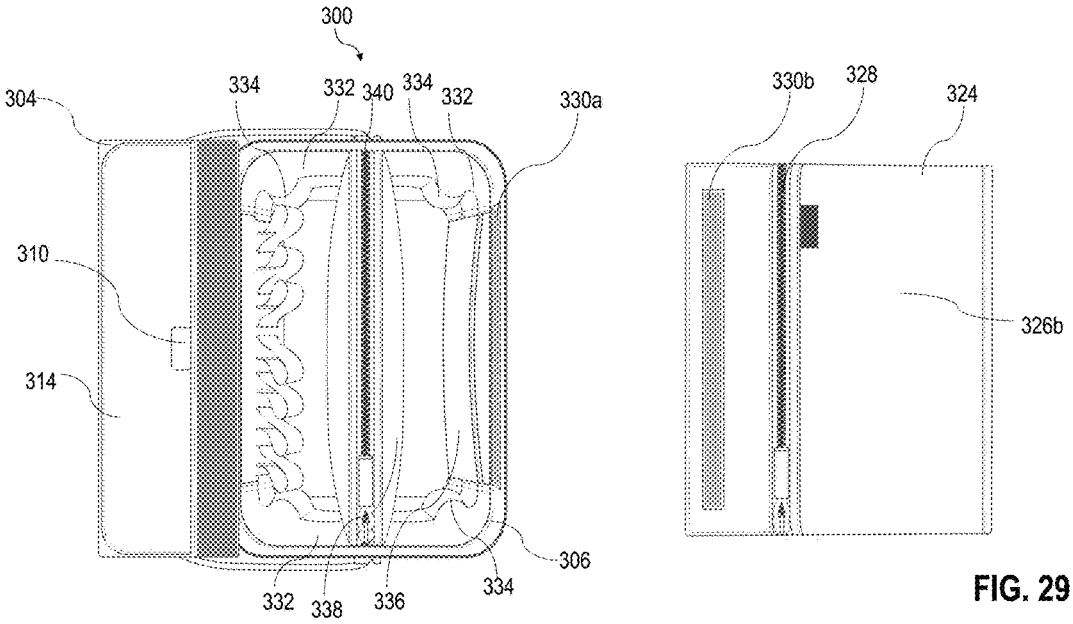
FIG. 29 illustrates a top view of one embodiment of the handbag in FIG. 28 with a pouch detached.
Figure 30:
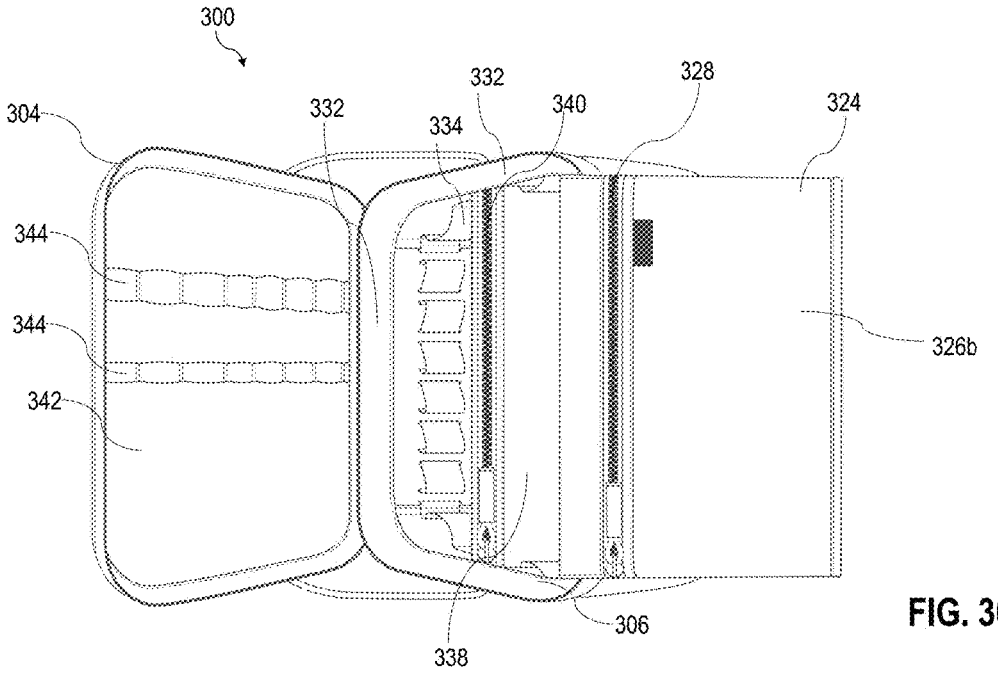
FIG. 30 illustrates a perspective view of the handbag of FIG. 28.

Now turning to FIGS. 27-30, handbag 300 includes various compartments within body 306. Lid 304 partially decouples (i.e., opens) from body 306 by applying force $F_{300}$ to tab 310, as shown in FIG. 27, to open handbag 300 into an open configuration as shown in FIGS. 27-30. Bag 324 rests inside handbag 300 between lid 304 and body 306. On a first side 326*a* of bag 324, as shown in FIG. 27, there are one or more adjustable or fixed loops 328 configured to received one or more elongate items or tools. On a second side 326*b* of bag 324, as shown in FIGS. 28-30, there is an access point 328 for opening and closing bag 324. In some embodiments, access point 328 comprises a zipper; in other embodiments, access point 328 comprises one or more buttons or hooks and eyelets, one or more magnets, Velcro®, or any other suitable reversible closure or fastening means. Bag 324 flips over a sidewall 332 of body 306 to reveal the second side 326*b*. Bag 324 is coupled to body 306 via coupling elements 330*a*, 330*b*, as shown in FIG. 29. In some embodiments, coupling elements 330*a*, 330*b* are magnets (e.g., permanent magnets and ferromagnets), as described elsewhere herein; in other embodiments, coupling elements 330*a*, 330*b* are hinges, Velcro®, buttons, hooks, or any reversible coupling means. As shown in FIG. 29, in some embodiments, bag 324 is completely detachable, and also can be reattached, to body 306.

As shown in FIGS. 23 and 28-30, body 306 is defined by base 316 and a plurality of sidewalls 332. A plurality of loops 334 is coupled to sidewalls 332 in an interior of body 306, as shown in FIGS. 28-30. Loops 334 may be adjustable or fixed, as described elsewhere herein. Loops 334 are sized and configured to receive receptacles housing liquid or other substances or other elongate items or tools. In some embodiments, one or more sidewalls 332 may further include one or more pockets 336 or slip pockets coupled thereto, as shown in FIGS. 28-29. Further, in some embodiments, body 306 includes pouch 338 coupled thereto, as shown in FIGS. 28-30. Pouch 338 includes one or more compartments or pockets therein and may be reversibly closed and opened via coupling element 340 or remain in an open state without a coupling element. In some embodiments, coupling element 340 is a zipper; in other embodiments, coupling element 340 comprises one or more buttons, hooks, Velcro®, magnets, or other mechanism, as described elsewhere herein.

Further, in some embodiments, as shown in FIG. 30, a bottom side 342 of lid 304 may include a plurality of loops 344, either adjustable or fixed loops for additional storage of elongate items or tools.

Figure 31:
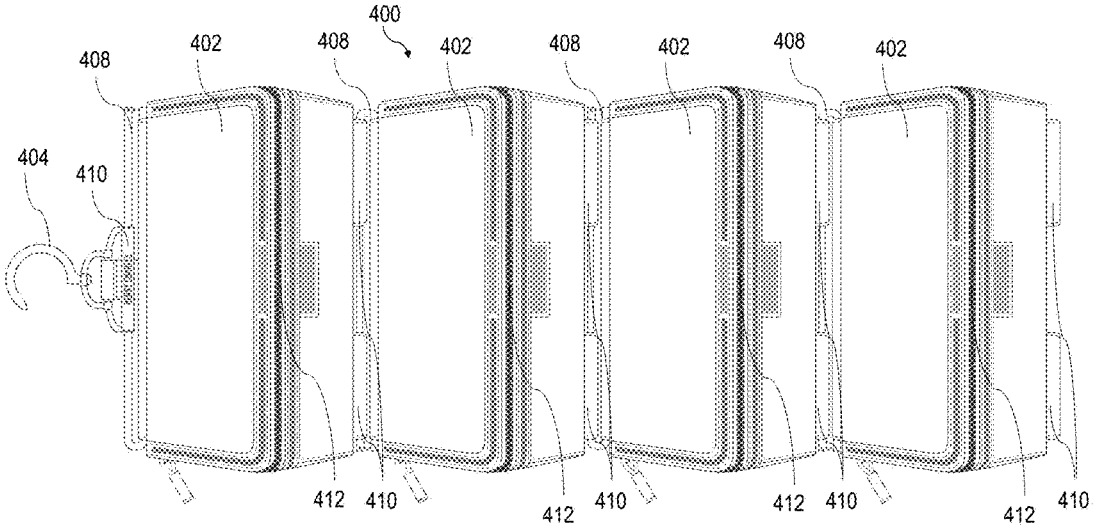
FIG. 31 illustrates a front view of another embodiment of a handbag.
Figure 32:
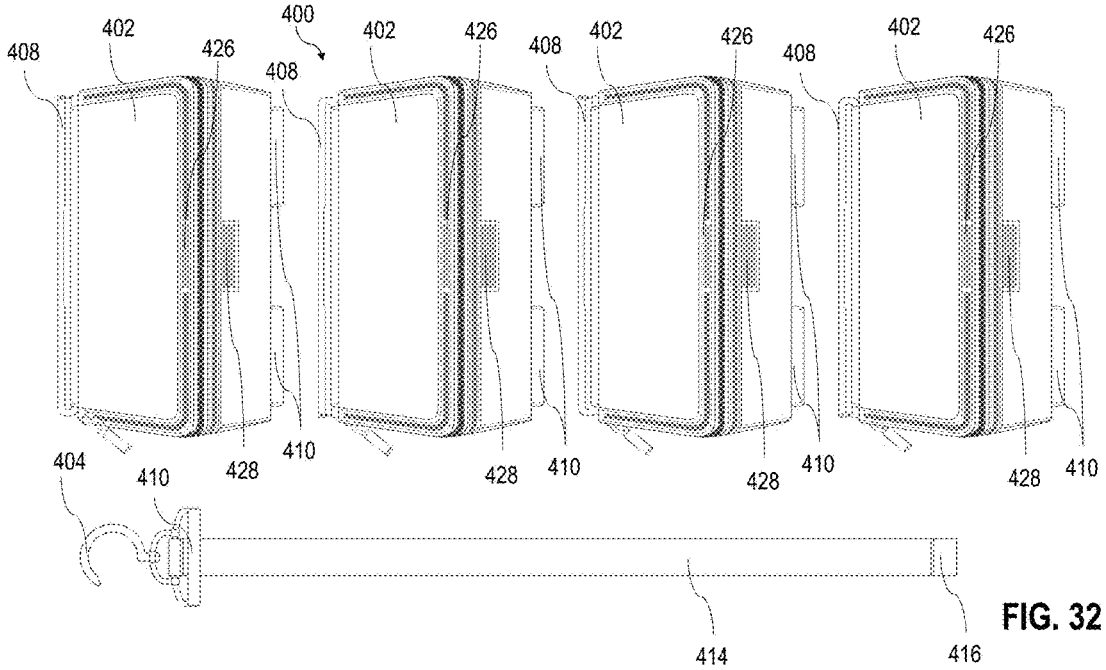
FIG. 32 illustrates a front view of one embodiment of the handbag of FIG. 31 disconnected from an elongate member.
Figure 33:
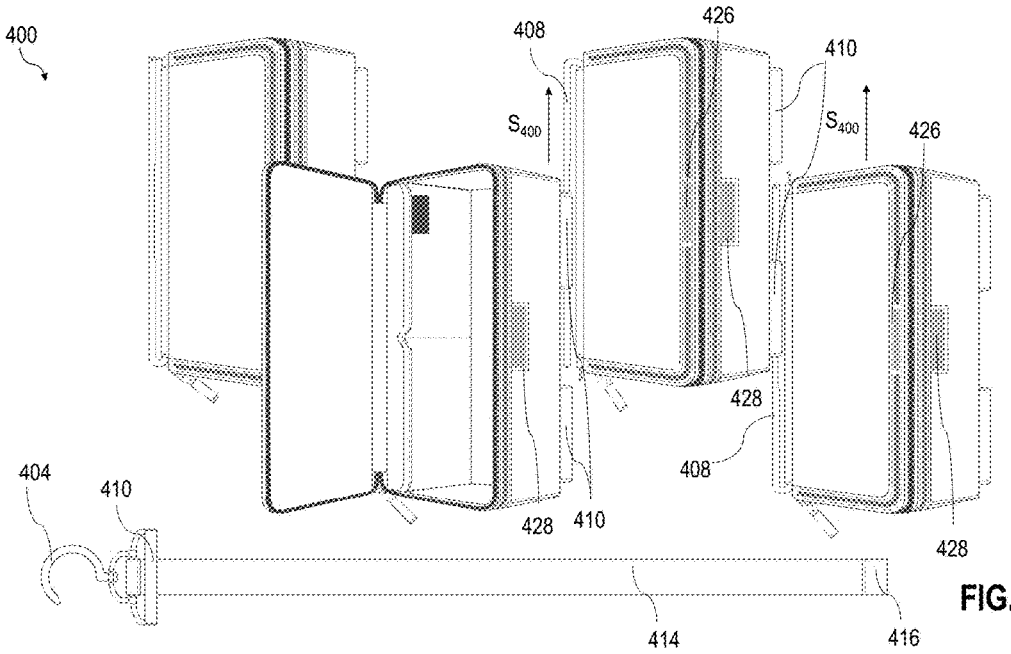
FIG. 33 illustrates a front view of one embodiment of the handbag of FIG. 31, showing how each compartment of the handbag couples to adjacent compartments and to an elongate member.

Turning now to FIGS. 31-39, another embodiment of a handbag is shown. Handbag 400 functions to provide several individual compartments that can be coupled together to form one elongate or rolled handbag that can be hung from any fixture, for example a door, rod, knob, hanger, or any other apparatus. As shown in FIGS. 31-33, handbag 400 includes one or more compartments 402 attached sequentially to one another, as shown in FIG. 33, and ultimately attached to hanging coupling element 404. Hanging coupling element 404, in some embodiments, swivels to allow handbag 400 to be coupled to any surface configuration or fixture. In other embodiments, hanging coupling element 404 is in a fixed configuration and does not swivel. As shown at least in FIG. 32, each compartment 402 includes one or more notched tabs 410 configured to engage with or couple to a bar 408 of the compartment 402 directly below or adjacent to it. In embodiments where the compartment 402 is coupling to hanging coupling element 404, bar 408 of compartment 402 couples to notched tab 410 connected to hanging coupling element 404 directly above or adjacent to it. FIG. 33 shows how notched tabs 410 are coupled to bar 408. A sliding action $S_{400}$ or hooking action is applied to each compartment 402 to couple it to the compartments 402 below, above, or adjacent to it. Bar 408 is further configured to and functions as a reinforcement to hold tools and products in place in each compartment 402 and prevent compartment 402 sagging and drooping. As shown and described, compartments 402 can be arranged in any order to suit the needs of the user. Further, one compartment 402 can be used in isolation from other compartments or used together with one or more additional compartments 402, allowing maximum flexibility for the user.

Figure 38:
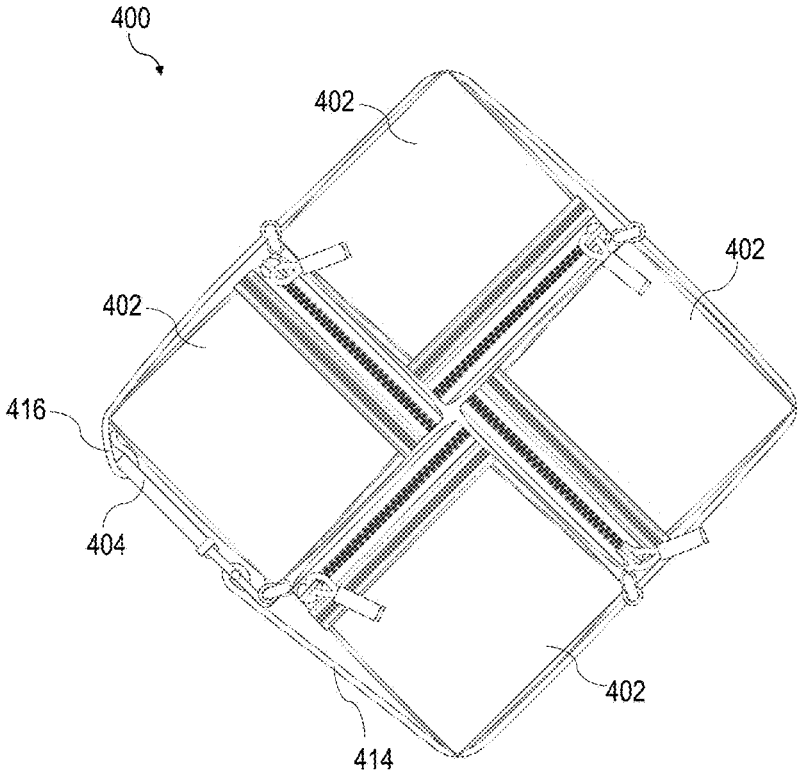
FIG. 38 illustrates a side view of one embodiment of a rolled-up configuration of the handbag of FIG. 37A.
Figure 39:
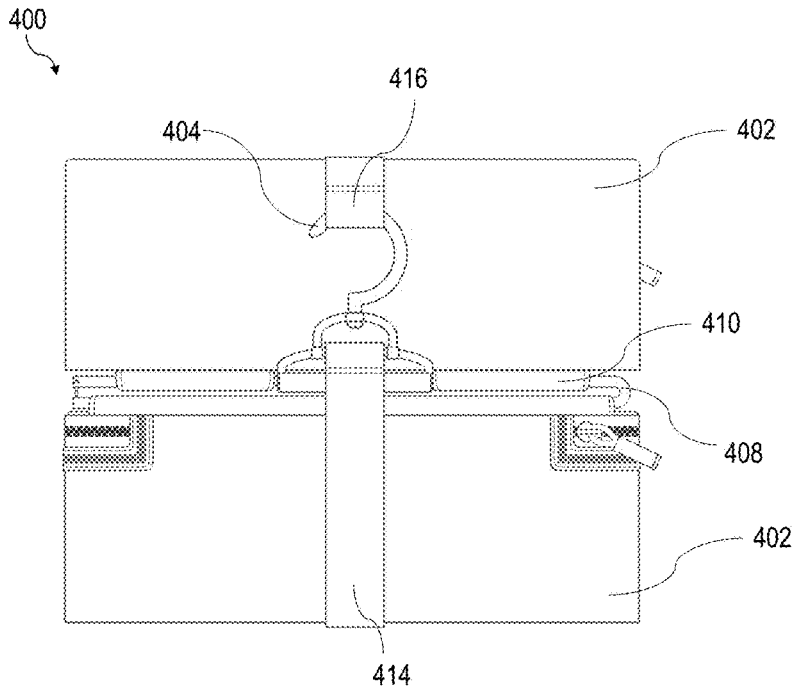
FIG. 39 illustrates a top view of one embodiment of the handbag of FIG. 38.

Hanging coupling element 404 is further coupled to an elongate member 414, which is coupled to loop 416. When compartments 402 are in a rolled configuration, as shown in FIGS. 38-39, elongate member 414 encircles compartments 402 and loop 416 couples to hanging coupling element 404 to secure the compartments 402 in the rolled configuration. In some embodiments, elongate member 414 is elastic or is formed of a stretchable material; in other embodiments, elongate member 414 is formed of or comprises any material known in the art, as described elsewhere herein.

Figure 34:
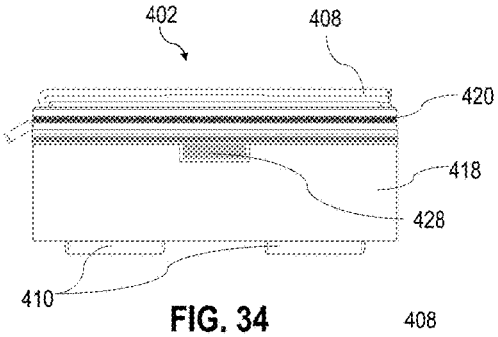
FIG. 34 illustrates a front view of one embodiment of a compartment of the handbag of FIG. 31.
Figure 36:
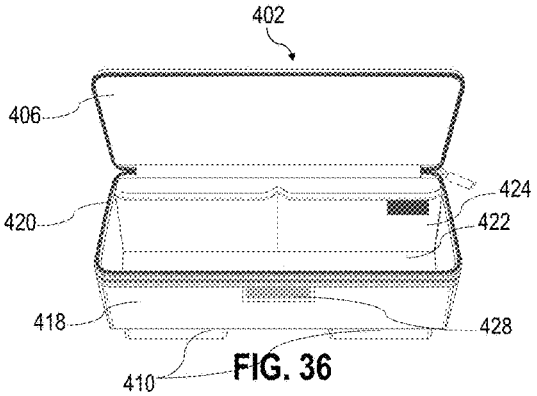
FIG. 36 illustrates a perspective front view of one embodiment of a compartment in an open configuration of the handbag of FIG. 31.
Figure 35:
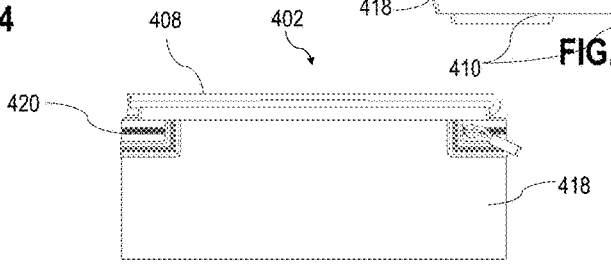
FIG. 35 illustrates a rear view of one embodiment of a compartment of the handbag of FIG. 31.

As shown in FIGS. 34-36, each compartment 402 includes lid 406 and body 418 hingedly coupled together via coupling element 420. In some embodiments, coupling element 420 is a zipper; in other embodiments, coupling element 420 is Velcro®, one or more buttons, hooks, or latches, one or more magnets, or another coupling mechanism known in the art. An interior 422 of each compartment 402 includes one or more pockets 424 or slip pockets for storing or housing one or more tools, receptacles, cosmetics, etc. Further, as shown in FIGS. 34-36, each compartment 402 includes one or more notched tabs 410 and a bar 408 to couple compartments 402 to one another and/or to hanging coupling element 404, as described elsewhere herein.

Figure 37A:
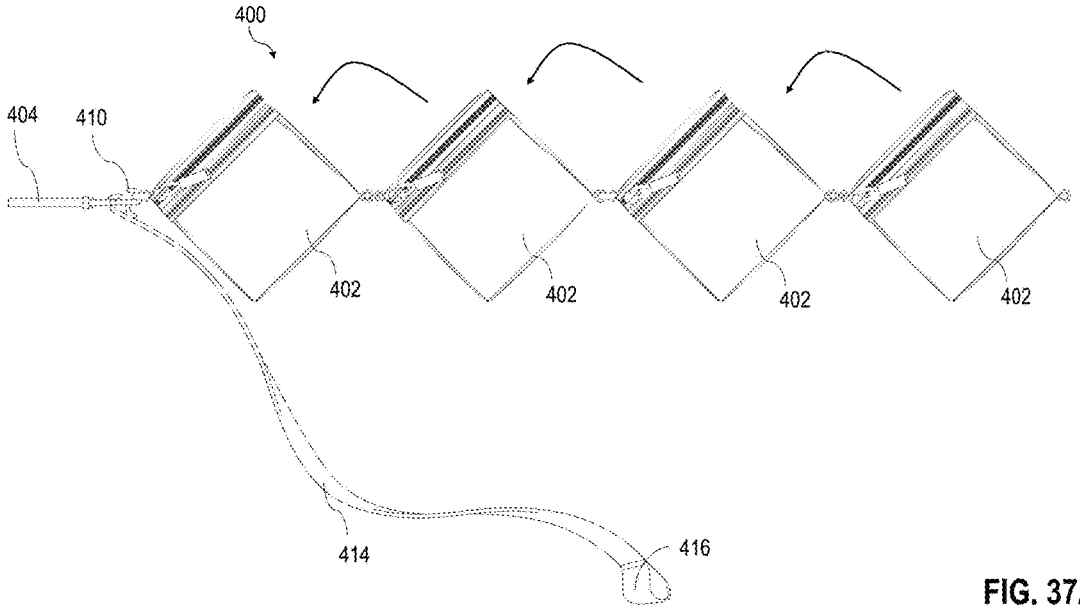
FIG. 37A illustrates a side view of one embodiment of the handbag of FIG. 31.
Figure 37B:
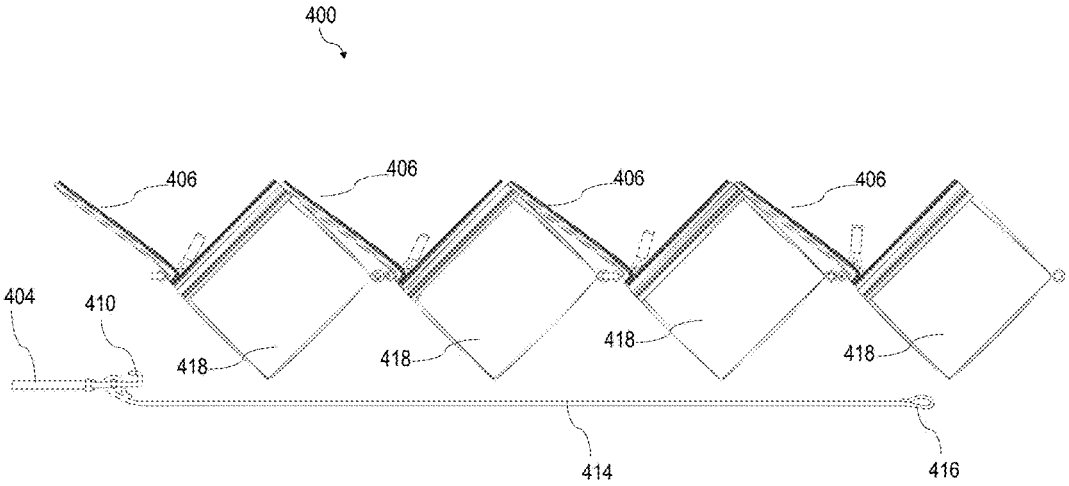
FIG. 37B illustrates a side view of one embodiment of the handbag of FIG. 37A, showing lids on individual compartments in an open position.

Further, as shown in FIG. 37B, during use, lid 406 of an instant compartment 402 couples to body 418 of the compartment 402 directly above, before, or adjacent to it to allow easy access to the contents of each compartment 402 without worrying about lid 406 obscuring or blocking access to the contents within the compartment 402. To enable this, lid 406 includes lid coupling element 426, as shown in FIGS. 32-33, and body 418 includes body coupling element 428, as shown in FIGS. 34 and 36. As such, each lid coupling element 426 on each lid 406 couples to each body coupling element 428 on each body 418 to maintain each lid 406 in an open configuration while compartments 402 are in use. Of course, one of skill in the art will recognize that, in some embodiments, only one compartment may be in use or a plurality of compartments may be use at a given time. In some embodiments, lid coupling element 426 and body coupling element 428 include complementary magnets; in other embodiments, lid coupling element 426 and body coupling element 428 include one or more buttons, zippers, Velcro®, hooks, or any other type of fastener.

As used in the description and claims, the singular form "a", "an" and "the" include both singular and plural references unless the context clearly dictates otherwise. For example, the term "a pocket" may include, and is contemplated to include, a plurality of pockets. At times, the claims and disclosure may include terms such as "a plurality," "one or more," or "at least one;" however, the absence of such terms is not intended to mean, and should not be interpreted to mean, that a plurality is not conceived.

The term "about" or "approximately," when used before a numerical designation or range (e.g., to define a length or pressure), indicates approximations which may vary by (+) or (−) 5%, 1% or 0.1%. All numerical ranges provided herein are inclusive of the stated start and end numbers. The term "substantially" indicates mostly (i.e., greater than 50%) or essentially all of a device, substance, or composition.

As used herein, the term "comprising" or "comprises" is intended to mean that the devices, systems, and methods include the recited elements, and may additionally include any other elements. "Consisting essentially of" shall mean that the devices, systems, and methods include the recited elements and exclude other elements of essential significance to the combination for the stated purpose. Thus, a system or method consisting essentially of the elements as defined herein would not exclude other materials, features, or steps that do not materially affect the basic and novel characteristic(s) of the claimed disclosure. "Consisting of" shall mean that the devices, systems, and methods include the recited elements and exclude anything more than a trivial or inconsequential element or step. Embodiments defined by each of these transitional terms are within the scope of this disclosure.

The examples and illustrations included herein show, by way of illustration and not of limitation, specific embodiments in which the subject matter may be practiced. Other embodiments may be utilized and derived therefrom, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A cosmetic bag, comprising:

a base;

a first sidewall extending from an edge of the base and coupled to a first coupling surface;

a second sidewall extending from an opposite edge of the base and coupled to a second coupling surface, the second sidewall and the second coupling surface defining a groove configured as a handle, wherein, in a closed configuration, the first coupling surface bends over the second coupling surface and is configured to couple to the second coupling surface, and wherein the first and second sidewalls each comprise one or more loops and one or more pockets coupled thereto;

a reversibly sealable pouch between the first and second sidewalls, the pouch being visible between the first and second sidewalls in the closed configuration;

a first divider between the first sidewall and the pouch, the first divider and the first sidewall defining a first pocket and the first divider and the pouch defining a second pocket; and a second divider between the second sidewall and the pouch, the second divider and the second sidewall defining a third pocket and the second divider and the pouch defining a fourth pocket, wherein the one or more loops, the one or more pockets, an interior of the pouch, the first pocket, the second pocket, the third pocket, and the fourth pocket are all visible simultaneously when the cosmetic bag is in an open configuration.

2. The cosmetic bag of claim 1, wherein the pouch houses two or more compartments therein.

3. The cosmetic bag of claim 1, wherein the first coupling surface comprises a protruding permanent magnet and the second coupling surface comprises a recessed ferromagnet.

4. The cosmetic bag of claim 1, wherein one or more of the first divider, the second divider, and the one or more pockets are formed of mesh.

5. The cosmetic bag of claim 1, wherein a size of the one or more loops are adjustable.

6. The cosmetic bag of claim 1, wherein the base further comprises one or more feet configured to maintain the base apart from a surface on which the cosmetic bag rests.

7. The cosmetic bag of claim 1, wherein the pouch comprises a zipper for sealing and unsealing the pouch.

8. The cosmetic bag of claim 1, wherein a width of the first sidewall tapers from a first end coupled to the base to a second end coupled to the first coupling surface.

9. A cosmetic bag having an open configuration and a closed configuration, the cosmetic bag comprising:

a first sidewall comprising a first coupling surface;

a second sidewall coupled to the first sidewall and comprising a second coupling surface, the second sidewall and the second coupling surface defining a groove configured as a handle, wherein, in the closed configuration, the first coupling surface is configured to couple to the second coupling surface, and wherein the first and second sidewall each comprise one or more loops and one or more pockets coupled thereto;

a reversibly sealable pouch coupled to and between the first and second sidewalls, the pouch being visible between the first and second sidewalls in the closed configuration;

a first divider between the first sidewall and the pouch, the first divider and the first sidewall defining a first slot and the first divider and the pouch defining a second slot; and a second divider between the second sidewall and the pouch, the second divider and the second sidewall defining a third slot and the second divider and the pouch defining a fourth slot, wherein the one or more loops, the one or more pockets, an interior of the pouch, the first slot, the second slot, the third slot, and the fourth slot are all visible simultaneously when the cosmetic bag is in the open configuration.

10. The cosmetic bag of claim 9, wherein the first and second sidewalls are formed of a flexible material.

11. The cosmetic bag of claim 9, wherein the pouch comprises a first side and a second side reversibly joined by a zipper.

12. The cosmetic bag of claim 9, further comprising a base.

13. The cosmetic bag of claim 12, wherein the first and second sidewalls are coupled to the base, the first sidewall being coupled to the base along a half perimeter and the second sidewall being coupled to the base along an opposite half perimeter.

14. The cosmetic bag of claim 12, wherein the base further comprises one or more feet configured to maintain the base apart from a surface on which the cosmetic bag rests.

15. The cosmetic bag of claim 9, wherein the pouch houses two or more compartments therein.

16. The cosmetic bag of claim 9, wherein the first coupling surface comprises a protruding permanent magnet and the second coupling surface comprises a recessed ferromagnet.

17. The cosmetic bag of claim 16, wherein a material comprising the first and second sidewalls covers the permanent magnet and the ferromagnet.

18. The cosmetic bag of claim 9, wherein one or more of the first divider, the second divider, and the one or more pockets are formed of mesh.

19. The cosmetic bag of claim 9, wherein a size of the one or more loops are adjustable.

20. The cosmetic bag of claim 9, further comprising a tab coupled to the first coupling surface, the tab being configured to be pulled to disengage the first coupling surface from the second coupling surface in the closed configuration.

* * * * *